US012492500B2

(12) United States Patent
Lee et al.

(10) Patent No.: US 12,492,500 B2
(45) Date of Patent: Dec. 9, 2025

(54) WASHING MACHINE AND CONTROLLING METHOD FOR THE SAME

(71) Applicant: SAMSUNG ELECTRONICS CO., LTD., Suwon-si (KR)

(72) Inventors: Sungmo Lee, Suwon-si (KR); Junhyun Park, Suwon-si (KR); Sugkil Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 404 days.

(21) Appl. No.: 18/078,652

(22) Filed: Dec. 9, 2022

(65) Prior Publication Data

US 2023/0265590 A1 Aug. 24, 2023

Related U.S. Application Data

(63) Continuation of application No. PCT/KR2022/018547, filed on Nov. 23, 2022.

(30) Foreign Application Priority Data

Feb. 22, 2022 (KR) ..... 10-2022-0023260

(51) Int. Cl.
*D06F 33/48* (2020.01)
*D06F 33/40* (2020.01)
*D06F 103/26* (2020.01)

(52) U.S. Cl.
CPC ..... *D06F 33/48* (2020.02); *D06F 33/40* (2020.02); *D06F 2103/26* (2020.02)

(58) Field of Classification Search
None
See application file for complete search history.

(56) References Cited

U.S. PATENT DOCUMENTS 9,896,795 B2 2/2018 Bae
11,466,388 B2 10/2022 Choung et al.
(Continued)

FOREIGN PATENT DOCUMENTS

EP 3051016 A1 * 8/2016 ..... D06F 33/32
JP 2006-311886 A 11/2006
(Continued)

OTHER PUBLICATIONS

International Search Report, PCT/ISA/210, dated Mar. 17, 2023, in International Application No. PCT/KR2022/018547.
(Continued)

*Primary Examiner* — Cristi J Tate-Sims
(74) *Attorney, Agent, or Firm* — STAAS & HALSEY LLP

(57) ABSTRACT

A washing machine, and a method of controlling the same, the washing machine including a tub; a drum in the tub; a motor configured to rotate the drum; a vibration sensor configured to detect vibration of the tub as the drum is rotated during a dehydrating course, and to produce a corresponding vibration value; and a controller configured to stop the motor to stop the dehydrating course based on the vibration value produced by the vibration sensor indicating that vibration of the tub exceeds an acceptable standard of vibration during the dehydrating course, and thereafter restart the dehydrating course, and change the acceptable standard of vibration based on a number of times of restarting the dehydrating course in a plurality of laundry cycles.

11 Claims, 15 Drawing Sheets

(56) References Cited

U.S. PATENT DOCUMENTS

| | | | | |
|---|---|---|---|---|
| 11,639,572 | B2 | 5/2023 | Bae et al. | |
| 2004/0098813 | A1* | 5/2004 | Son | D06F 33/48 68/12.02 |
| 2017/0321363 | A1 | 11/2017 | Kawaguchi et al. | |
| 2019/0264373 | A1 | 8/2019 | Bae | |
| 2020/0248358 | A1 | 8/2020 | Bae et al. | |
| 2020/0248359 | A1* | 8/2020 | Bae | D06F 33/48 |

FOREIGN PATENT DOCUMENTS

| | | | |
|---|---|---|---|
| JP | 4812789 | | 11/2011 |
| JP | 5650927 | | 1/2015 |
| JP | 2016-112136 | A | 6/2016 |
| JP | 6467703 | | 2/2019 |
| JP | 2019-162324 | | 9/2019 |
| KR | 10-0493300 | | 6/2005 |
| KR | 10-2008-0040947 | | 5/2008 |
| KR | 10-1447148 | | 10/2014 |
| KR | 10-2015-0052696 | | 5/2015 |
| KR | 10-1708658 | B1 | 2/2017 |
| KR | 10-2018-0029333 | | 3/2018 |
| KR | 10-2020-0095997 | A | 8/2020 |
| KR | 10-2020-0095997 | | 11/2020 |
| KR | 10-2021-0097457 | | 8/2021 |
| WO | WO 2021/025193 | A1 | 2/2021 |

OTHER PUBLICATIONS

Written Option, PCT/ISA/237, dated Mar. 17, 2023, in International Application No. PCT/KR2022/018547.

* cited by examiner

FIG. 10

| ELAPSED TIME (t) / ALLOWABLE STANDARD OF VIBRATION | t < t1 (FIRST ALLOWABLE STANDARD OF VIBRATION) | t1 ≤ t < t2 (SECOND ALLOWABLE STANDARD OF VIBRATION) | t ≥ t2 (THIRD ALLOWABLE STANDARD OF VIBRATION) |
|---|---|---|---|
| LEVEL 1 | FIRST STANDARD | FIRST STANDARD | THIRD STANDARD |
| LEVEL 2 | FIRST STANDARD | SECOND STANDARD | THIRD STANDARD |
| LEVEL 3 | SECOND STANDARD | SECOND STANDARD | THIRD STANDARD |
| LEVEL 4 | SECOND STANDARD | THIRD STANDARD | THIRD STANDARD |
| LEVEL 5 | THIRD STANDARD | THIRD STANDARD | THIRD STANDARD |

WASHING MACHINE AND CONTROLLING METHOD FOR THE SAME

CROSS-REFERENCE TO RELATED APPLICATION

This application is a continuation application, under 35 U.S.C. § 111(a), of international application No. PCT/KR2022/018547, filed on Nov. 23, 2022, which claims priority under 35 U. S. C. § 119 to Korean Patent Application No. 10-2022-0023260 filed on Feb. 22, 2022, the disclosures of which are incorporated herein by reference in their entireties.

BACKGROUND

1. Field

The disclosure relates to a washing machine and method for controlling the same, and more particularly, to a washing machine and method for controlling the same capable of preventing a time delay of a dehydrating course and reducing vibration noise caused during the dehydrating course.

2. Description of the Related Art

In general, a washing machine may include a tub and a drum rotationally installed in the tub, and may do laundry by rotating the drum containing clothes inside the tub. The washing machine may perform a washing course for washing the clothes, a rinsing course for rinsing the washed clothes, and a dehydrating course for dehydrating the clothes.

The dehydrating course is a course to separate water absorbed in the clothes contained in the drum from the clothes by accelerating the drum at high speed and decelerating the drum.

During the dehydrating course, as the drum is rotated at high speed, clothes unevenly distributed on one side of the drum may cause severe vibration, which may damage components of the washing machine. To prevent this, the washing machine stops the drum when the severe vibration occurs during the dehydrating course and restarts the dehydrating course.

SUMMARY

Aspects of embodiments of the disclosure will be set forth in part in the description which follows and, in part, will be apparent from the description, or may be learned by practice of the embodiments.

According to an embodiment of the disclosure, a washing machine may include a tub; a drum in the tub; a motor configured to rotate the drum; a vibration sensor configured to detect vibration of the tub as the drum is rotated during a dehydrating course, and to produce a corresponding vibration value; and a controller configured to stop the motor to stop the dehydrating course based on the vibration value produced by the vibration sensor indicating that vibration of the tub exceeds an acceptable standard of vibration during the dehydrating course, and thereafter restart the dehydrating course, and change the acceptable standard of vibration based on a number of times of restarting the dehydrating course in a plurality of laundry cycles.

According to an embodiment of the disclosure, the controller is configured to decrease an average of a plurality of vibration limit values included in the acceptable standard of vibration based on the number of times of restarting the dehydrating course being smaller than a preset first value, maintain the acceptable standard of vibration based on the number of times of restarting the dehydrating course being equal to or greater than the preset first value, and smaller than a preset second value, and increase the average of the plurality of vibration limit values included in the acceptable standard of vibration based on the number of times of restarting the dehydrating course being equal to or greater than the preset second value.

According to an embodiment of the disclosure, the acceptable standard of vibration includes a first acceptable standard of vibration, a second acceptable standard of vibration and a third acceptable standard of vibration, and the controller is configured to restart the dehydrating course in response to the vibration value exceeding the first acceptable standard of vibration based on a first preset time not having passed from a point in time at which the dehydrating course is started a first time, restart the dehydrating course in response to the vibration value exceeding the second acceptable standard of vibration based on the first preset time having passed and a second preset time not having passed from the point in time at which the dehydrating course is started the first time, and restart the dehydrating course in response to the vibration value exceeding the third acceptable standard of vibration based on the second preset time having passed from the point in time at which the dehydrating course is started the first time.

According to an embodiment of the disclosure, the controller is configured to change the acceptable standard of vibration by changing at least one of the first acceptable standard of vibration, the second acceptable standard of vibration, and the third acceptable standard of vibration.

According to an embodiment of the disclosure, the first acceptable standard of vibration, the second acceptable standard of vibration and the third acceptable standard of vibration are each set to a first standard, a second standard, or a third standard, the first standard includes a plurality of first vibration limit values corresponding to a plurality of sections of the dehydrating course, the second standard includes a plurality of second vibration limit values corresponding to the plurality of sections of the dehydrating course, the third standard includes a plurality of third vibration limit values corresponding to the plurality of sections of the dehydrating course, and an average of the plurality of first vibration limit values is smaller than an average of the plurality of second vibration limit values, and the average of the plurality of second vibration limit values is smaller than an average of the plurality of third vibration limit values.

According to an embodiment of the disclosure, the washing machine further includes a display, wherein the controller is configured to control the display to output at least one of a visual indication indicating the number of times of restarting the dehydrating course and a message corresponding to the number of times of restarting the dehydrating course.

According to an embodiment of the disclosure, the washing machine further includes a communication device, wherein the controller is configured to control the communication device to transmit information about the number of times of restarting the dehydrating course to an external device.

According to an embodiment of the disclosure, the controller is configured to change at least one of the preset first value and the preset second value according to data input to a pre-trained artificial neural network, including data about the vibration value produced by the vibration sensor during the dehydrating course, data about the number of times of restarting the dehydrating course in the plurality of laundry cycles, data about time spent to complete the dehydrating course, and data about a weight of laundry contained in the drum.

According to an embodiment of the disclosure, the controller is configured to change at least one of the plurality of first vibration limit values, the plurality of second vibration limit values, and the plurality of third vibration limit values according to data input to a pre-trained artificial neural network, including data about the vibration value produced by the vibration sensor during the dehydrating course, data about the number of times of restarting the dehydrating course in the plurality of laundry cycles, data about time spent to complete the dehydrating course, and data about a weight of laundry contained in the drum.

According to an embodiment of the disclosure, the washing machine further includes a control panel configured to receive a user input to change the acceptable standard of vibration, wherein the controller is configured to change the acceptable standard of vibration based on the user input.

According to an embodiment of the disclosure, a method of controlling a washing machine includes detecting vibration of a tub of the washing machine as a drum in the tub is rotated during a dehydrating course, and producing a corresponding vibration value; stopping a motor that rotates the drum, to stop the dehydrating course, based on the vibration value indicating that vibration of the tub exceeds an acceptable standard of vibration during the dehydrating course; restarting the dehydrating course; and changing the acceptable standard of vibration based on a number of times of restarting the dehydrating course in a plurality of laundry cycles.

According to an embodiment of the disclosure, the changing of the acceptable standard of vibration includes decreasing an average of a plurality of vibration limit values included in the acceptable standard of vibration based on the number of times of restarting the dehydrating course being smaller than a preset first value; maintaining the acceptable standard of vibration based on the number of times of restarting the dehydrating course being equal to or greater than the preset first value and smaller than a preset second value; and increasing the average of the plurality of vibration limit values included in the acceptable vibration level based on the number of times of restarting the dehydrating course being equal to or greater than the preset second value.

According to an embodiment of the disclosure, the acceptable standard of vibration includes a first acceptable standard of vibration, a second acceptable standard of vibration and a third acceptable standard of vibration, and the restarting of the dehydrating course includes restarting the dehydrating course in response to the vibration value exceeding the first acceptable standard of vibration based on a first preset time not having passed from a point in time at which the dehydrating course is started the first time; restarting the dehydrating course in response to the vibration value exceeding the second acceptable standard of vibration based on the first preset time having passed and a second preset time not having passed from the point in time at which the dehydrating course is started the first time; and restarting the dehydrating course in response to the vibration value exceeding the third acceptable standard of vibration based on the second preset time having passed from the point in time at which the dehydrating course is started the first time.

According to an embodiment of the disclosure, the changing of the acceptable standard of vibration includes changing at least one of the first acceptable standard of vibration, the second acceptable standard of vibration, and the third acceptable standard of vibration.

According to an embodiment of the disclosure, the first acceptable standard of vibration, the second acceptable standard of vibration and the third acceptable standard of vibration are each set to a first standard, a second standard, or a third standard, the first standard includes a plurality of first vibration limit values corresponding to a plurality of sections of the dehydrating course, the second standard includes a plurality of second vibration limit values corresponding to the plurality of sections of the dehydrating course, the third standard includes a plurality of third vibration limit values corresponding to the plurality of sections of the dehydrating course, and an average of the plurality of first vibration limit values is smaller than an average of the plurality of second vibration limit values, and the average of the plurality of second vibration limit values is smaller than an average of the plurality of third vibration limit values.

Additional embodiments of the disclosure will be set forth in part in the description which follows and, in part, will be obvious from the description, or will be apparent from the disclosure.

BRIEF DESCRIPTION OF THE DRAWINGS

These and/or other embodiments of the disclosure will become apparent and more readily appreciated from the following description of the embodiments, taken in conjunction with the accompanying drawings of which:

FIG. 10 illustrates an example of a table representing a plurality of acceptable standards of vibration according to an embodiment of the disclosure;

DETAILED DESCRIPTION

Figure 1:
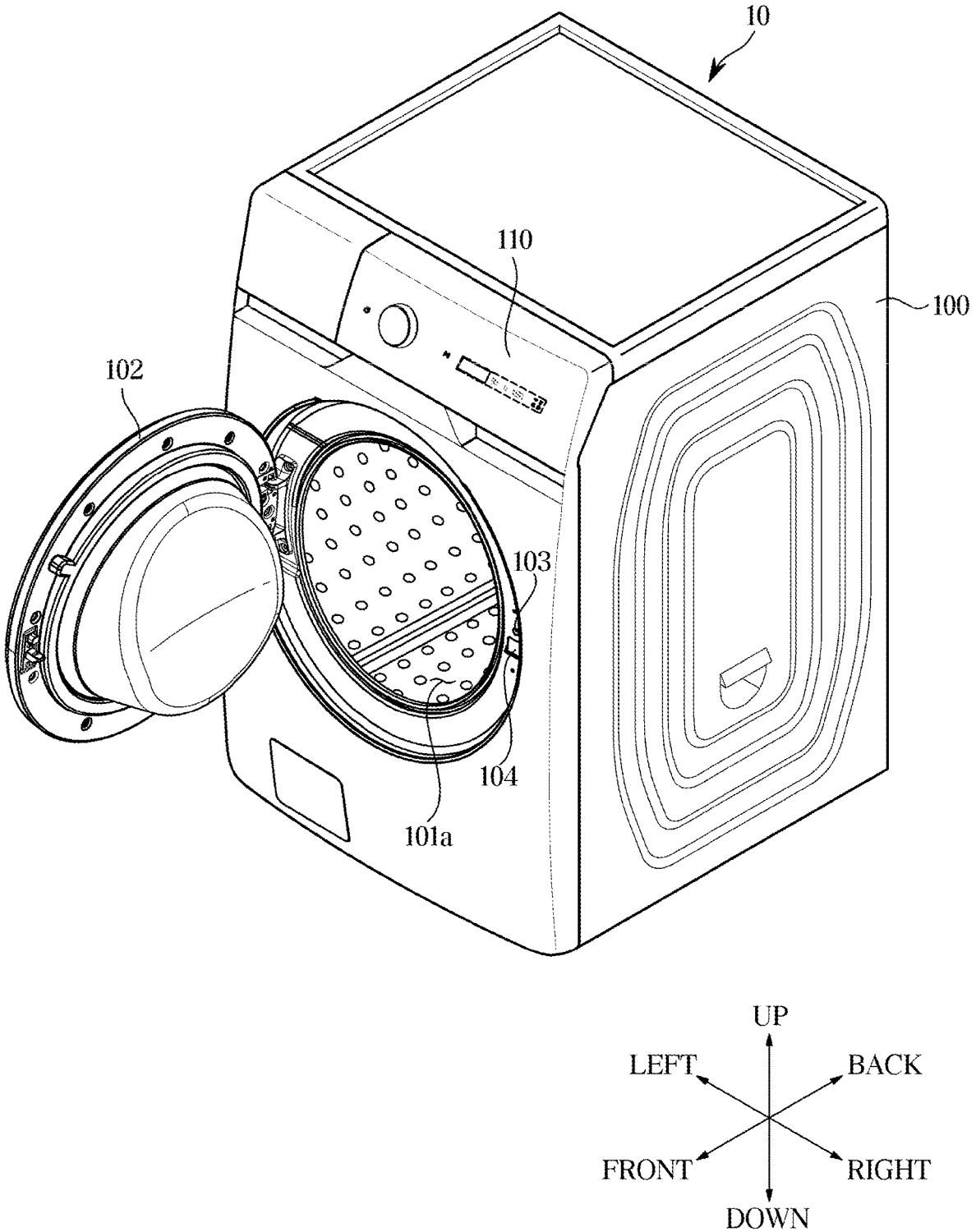
FIG. 1 is an exterior view of a washing machine according to an embodiment of the disclosure.

Embodiments and features as described and illustrated in the disclosure are merely examples, and there may be various modifications replacing the embodiments and drawings at the time of filing this application.

The terminology used herein is for the purpose of describing particular embodiments only and is not intended to limit the disclosure.

For example, the singular forms "a", "an" and "the" as herein used are intended to include the plural forms as well, unless the context clearly indicates otherwise.

The terms "comprises" and/or "comprising," when used in this specification, represent the presence of stated features, integers, steps, operations, elements, components or combinations thereof, but do not preclude the presence or addition of one or more other features, integers, steps, operations, elements, components, or combinations thereof.

The term including an ordinal number such as "first", "second", or the like is used to distinguish one component from another and does not restrict the former component.

Furthermore, the terms, such as "~part", "~block", "~member", "~module", etc., may refer to a unit of handling at least one function or operation. For example, the terms may refer to at least one process handled by hardware such as a field-programmable gate array (FPGA)/application specific integrated circuit (ASIC), etc., software stored in a memory, or at least one processor.

Embodiments of the disclosure may provide a washing machine, and a method for controlling the same, capable of minimizing a time delay and vibration noise by taking laundry habits of a user into account. The method may further include outputting at least one of a visual indication indicating the number of times of restarting the dehydrating course or a message corresponding to the number of times of restarting the dehydrating course. The method may further include transmitting information about the number of times of restarting the dehydrating course to an external device. The method may further include changing at least one of the preset first value or the preset second value by using data about a vibration value measured by the vibration sensor during the dehydrating course, data about the number of times of restarting the dehydrating course in the plurality of laundry cycles, data about time spent to complete the dehydrating course, and data about weight of laundry contained in the drum as input data to a pre-trained artificial neural network. The method may further include changing at least one of the plurality of first vibration limit values, the plurality of second vibration limit values or the plurality of third vibration limit values by using data about a vibration value measured by the vibration sensor during the dehydrating course, data about the number of times of restarting the dehydrating course in the plurality of laundry cycles, data about time spent to complete the dehydrating course, and data about weight of laundry contained in the drum as input data to a pre-trained artificial neural network. The method may further include receiving a user input to change the acceptable standard of vibration; and changing the acceptable standard of vibration based on the user input.

An embodiment of the disclosure will now be described in detail with reference to accompanying drawings. Throughout the drawings, like reference numerals or symbols refer to like parts or components.

The working principle and embodiments of the disclosure will now be described with reference to accompanying drawings.

Figure 2:
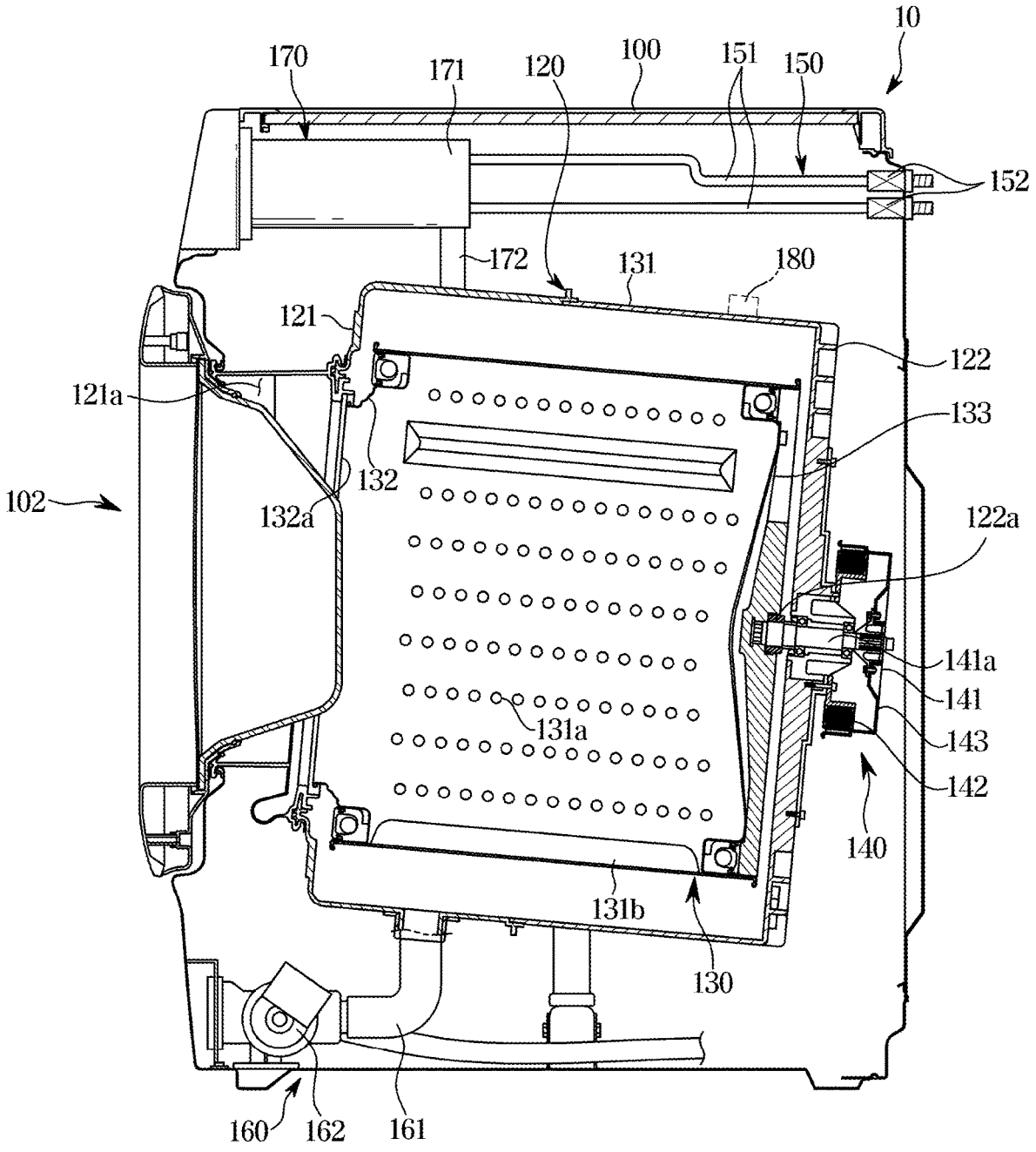
FIG. 2 is a side cross-sectional view of a washing machine according to an embodiment of the disclosure.

FIG. 1 is an exterior view of a washing machine, according to an embodiment of the disclosure, and FIG. 2 is a side cross-sectional view of a washing machine, according to an embodiment of the disclosure.

Referring to FIGS. 1 and 2, described is a configuration of a washing machine 10.

The washing machine 10 may be a drum-type washing machine that does the laundry by rotating a drum 130 to repeat rising and falling of the laundry, or an electric washing machine that does the laundry with water flows produced by a pulsator when the drum 130 is rotated. In the following description, assume that the washing machine 10 according to the embodiment of the disclosure is the drum-type washing machine.

Referring to FIGS. 1 to 2, the washing machine 10 may include a cabinet 100 and a door 102 arranged on the front of the cabinet 100. An inlet 101*a* may be formed in the middle of the front side of the cabinet 100 to draw in or out the laundry (or also referred to as clothes). The door 102 may be provided to open or close the inlet 101*a*. The door 102 may be mounted with a hinge to pivot on one side. That the inlet 101*a* is closed by the door 102 may be detected by a door switch 103. When the inlet 101*a* is closed and the washing machine 10 operates, the door 102 may be locked by a door lock 104.

The washing machine 10 may also include a control panel 110, a tub 120, the drum 130, a driver 140, a water supplier 150, a drain 160, a detergent supplier 170 and a vibration sensor 180.

A control panel 110 including an input 112 (shown in FIG. 3) for receiving a user input and a display 111 for displaying operation information of the washing machine 10 may be arranged in an upper portion of the front side of the cabinet 100. The control panel 110 may provide the user with a user interface to interact with the washing machine 10.

The tub 120 may be arranged inside the cabinet 100 and may contain water for washing and/or rinsing. The tub 120 may include tub front parts 121 with an opening 121*a* formed on the front, and tub rear parts 122 in the shape of a cylinder with a closed rear side. The opening 121*a* through which to draw in or out clothes to or from the drum 130 may be formed on the tub front parts 121. A bearing 122*a* is arranged on the rear wall of the tub rear parts 122 to rotationally fix a motor 141. The drum 130 may be rotationally arranged in the tub 120 and may contain the clothes to be washed. The drum 130 may include a cylindrical drum body 131, drum front parts 132 arranged on the front of the drum body 131 and drum rear parts 133 arranged on the back of the drum body 131. The tub 120 and the drum 130 may be positioned at an angle to the ground. However, it is also possible that the tub 120 and the drum 130 are positioned to be parallel with the ground.

On the inner surface of the drum body 131, through holes 131*a* connecting the inside of the drum 130 to the inside of the tub 120 and a lifter 131*b* for lifting the clothes up the drum 130 during rotation of the drum 130 may be arranged. An opening 132*a* through which to draw in or out clothes to or from the drum 130 may be formed on the drum front parts 132. The drum rear parts 133 may be connected to a shaft 141*a* of the motor 141 that rotates the drum 130.

The motor 141 may rotate the drum 130. The motor 141 may include the driver 140. The motor 141 may be arranged on the outside of the tub rear parts 122 and connected to the drum rear parts 133 through the shaft 141*a*. The shaft 141*a* may penetrate the tub rear parts 122 and may be rotationally supported by the bearing 122*a* arranged on the tub rear parts 122.

The motor 141 may include a stator 142 fixed on the outside of the tub rear parts 122 and a rotor 143 rotationally arranged and connected to the shaft 141*a*. The rotor 143 may be rotated by magnetic interaction with the stator 142, and the rotation of the rotor 143 may be delivered to the drum 130 through the shaft 141*a*. The motor 141 may include, for example, a brushless direct current motor (BLDC motor) or a permanent synchronous motor (PMSM) capable of easily controlling the rotation speed.

In various embodiments of the disclosure, the washing machine 10 may further include a pulstator (not shown) that rotates separately from the drum 130.

The pulsator may separately rotate from the drum 130 to form a water flow in the drum 130.

In an embodiment of the disclosure, the pulsator may receive power from the motor 141, or may receive power from a pulsator motor provided separately from the motor 141.

When the pulsator receives power from the motor 141, the motor 141 may be implemented by a dual rotor motor equipped with one stator and two rotors (e.g., an inner rotor and an outer rotor), and one of the two rotors may be connected to the drum 130 and the other one may be connected to the pulsator.

The water supplier 150 may supply water to the tub 120 and the drum 130. The water supplier 150 may include a water supply tube 151 connected to an external water source to supply water to the tub 120, and a water supply valve 152 arranged in the water supply tube 151. The water supply tube 151 may be arranged above the tub 120 and may extend to a detergent container 171 from the external water source. The water may flow to the tub 120 through the detergent container 171.

The water supply valve 152 may open or close the water supply tube 151 in response to an electric signal from a controller 190. In other words, the water supply valve 152 may allow or block the supply of water to the tub 120 from the external water source. The water supply valve 152 may include, for example, a solenoid valve that is opened or closed in response to an electric signal.

The drain 160 may drain out the water stored in the tub 120 and/or the drum 130. The drain 160 may include a drain tube 161 extending from the bottom of the tub 120 to the outside of the cabinet 100, and a drain pump 162 arranged at the drain tube 161. The drain pump 162 may pump the water in the drain tube 161 out of the cabinet 100.

The detergent supplier 170 may supply a detergent to the tub 120 and/or the drum 130. The detergent supplier 170 may be arranged above the tub 120 and may include the detergent container 171 and a mixing tube 172 that connects the detergent container 171 to the tub 120. The detergent container 171 may be connected to the water supply tube 151, and the water supplied through the water supply tube 151 may be mixed with the detergent in the detergent container 171. The mixture of the detergent and the water may be supplied to the tub 120 through the mixing tube 172.

Figure 3:
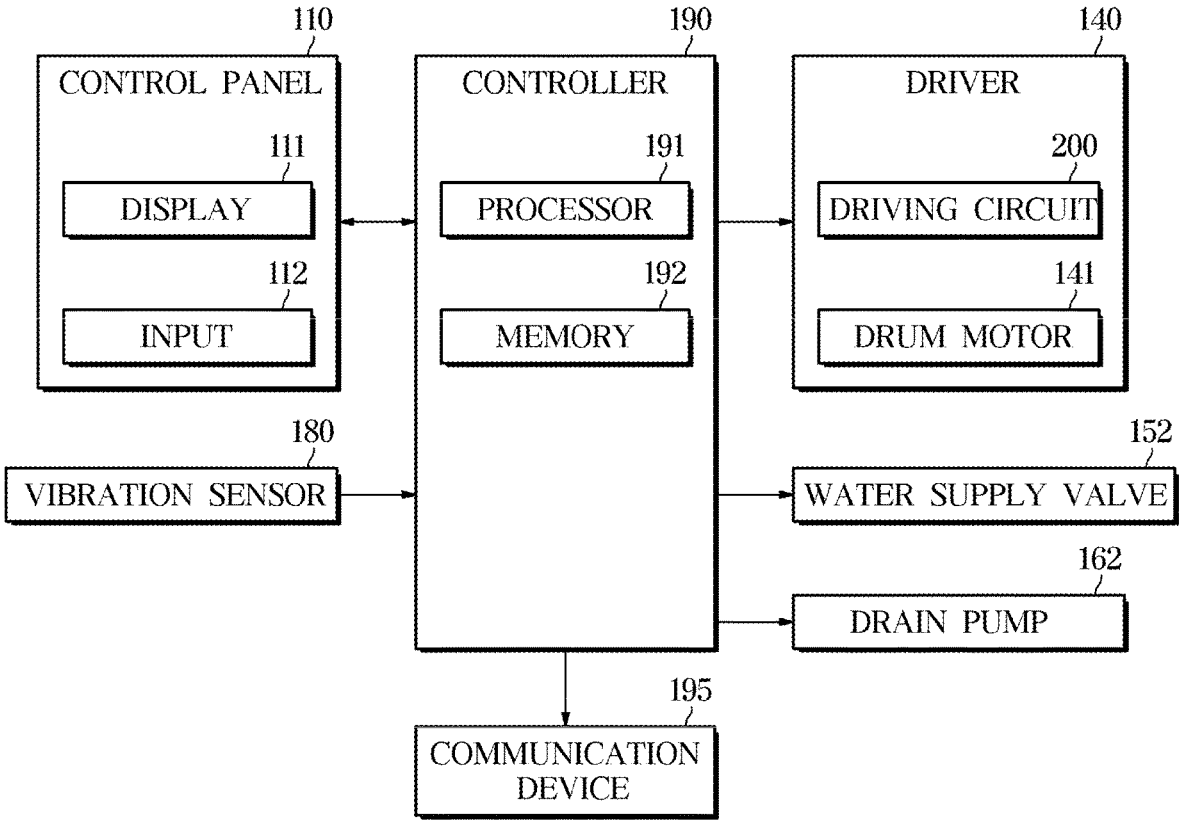
FIG. 3 is a control block diagram of a washing machine according to an embodiment of the disclosure.
Figure 4:
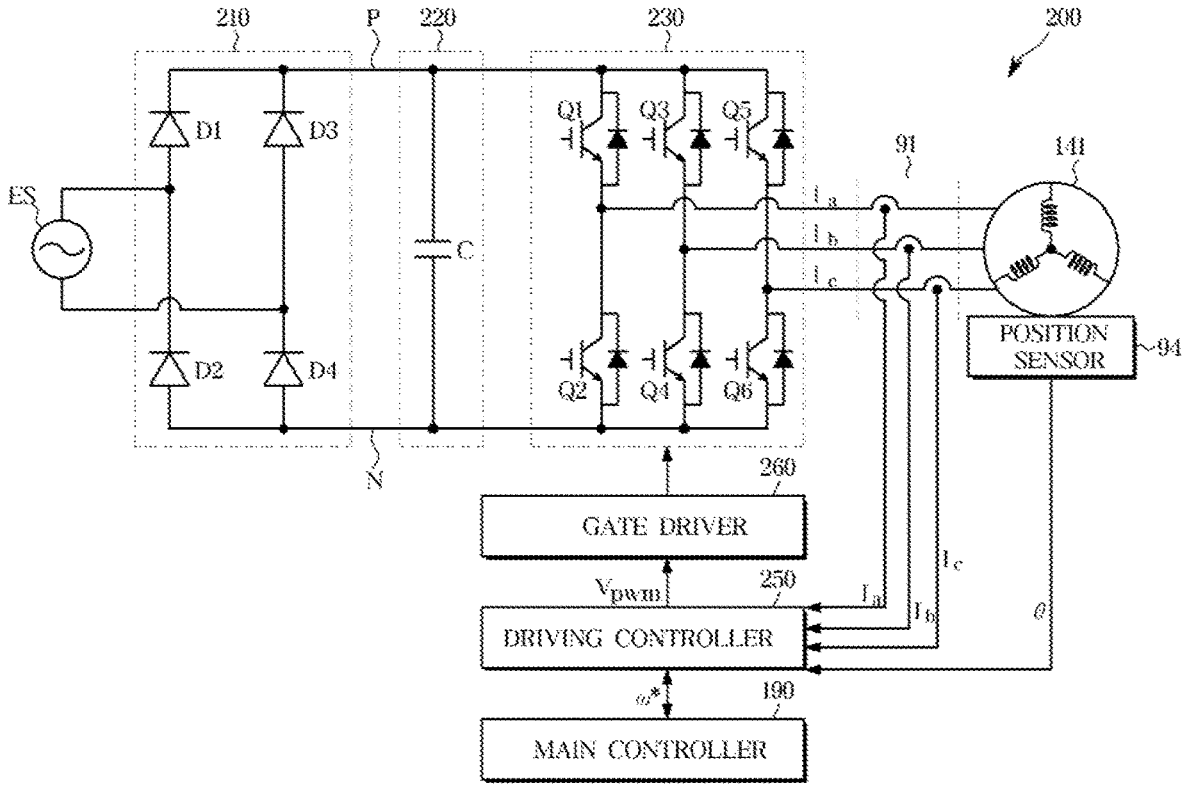
FIG. 4 illustrates an example of a driving circuit included in a washing machine according to an embodiment of the disclosure.
Figure 5:
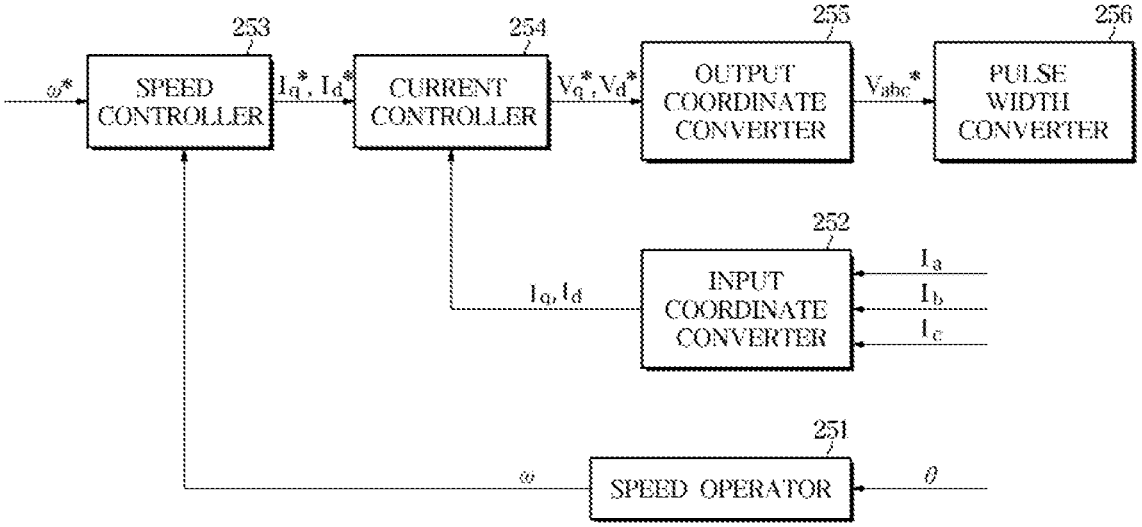
FIG. 5 illustrates an example of a driving controller included in a washing machine according to an embodiment of the disclosure.

FIG. 3 is a control block diagram of a washing machine, according to an embodiment of the disclosure, FIG. 4 illustrates an example of a driving circuit included in a washing machine, according to an embodiment of the disclosure, and FIG. 5 illustrates an example of a driving controller included in a washing machine, according to an embodiment of the disclosure.

The washing machine 10 may include not only the mechanical components described in connection with FIGS. 1 and 2 but also electrical/electronic components as will be described below.

Referring to FIGS. 3, 4 and 5, the washing machine 10 may include the control panel 110, the driver 140, the water supply valve 152, the drain pump 162, the vibration sensor 180 and the controller 190.

The washing machine 10 may include the control panel 110, the driver 140, the water supply valve 152, the drain pump 162, the vibration sensor 180, the controller 190 and/or a communication device 195. The controller 190 may be electrically connected to the components of the washing machine 10 to control the respective components.

The control panel 110 may include the display 111 for displaying a laundry setting and/or laundry operation information in response to a user input, and the input 112 for receiving a user input. The control panel 110 may provide the user with a user interface to interact with the washing machine 10. The input 112 may include, for example, a power button, a start button, a course selection dial, and a detailed setting button. The input 112 may also include a tact switch, a push switch, a slide switch, a toggle switch, a micro switch, or a touch switch.

The display 111 may include an indicator for indicating detailed settings selected by a setting button and a screen for displaying various information. The display 111 may include, for example, a liquid crystal display (LCD) panel and/or a light emitting diode (LED) panel.

A laundry course of the washing machine 10 may include preset washing settings (e.g., laundry temperature, the number of rinsing times, and dehydration intensity) depending on the type of clothes (e.g., shirts, pants, underwear, or bedclothes), the texture of clothes (e.g., cotton, polyester or wool) and an amount of clothes. For example, a standard laundry course may include universal laundry settings for clothes. A bedclothes laundry course may include laundry settings optimized to wash bedclothes. There may be various laundry courses such as standard washing, powerful washing, wool washing, bedclothes washing, infant clothes washing, towel washing, minimal washing, boiling washing, economic washing, outdoor clothes washing, rinsing+dehydrating, dehydrating, etc.

The driver 140 may include the motor 141 and a driving circuit 200. The driving circuit 200 may apply a driving current to the motor 141 for driving the motor 141 in response to a driving signal (a motor control signal) from the controller 190. The driving circuit 200 may rectify and convert alternate current (AC) power from an external power source to direct current (DC) power, and convert the DC power to sinusoidal driving power. The driving circuit 200 may include an inverter for outputting the converted driving power to the motor 141. The inverter may include a plurality of switching devices, and open (turn off) or close (turn on) the plurality of switching devices based on a driving signal from the controller 190. A driving current may be applied to the motor 141 according to the opening or closing of the switching devices. Furthermore, the driving circuit 200 may include a current sensor (not shown) for measuring a driving current output from the inverter.

The controller 190 may calculate a rotation speed of the motor 141 based on an electrical angle of the rotor. The electrical angle of the rotor may be obtained from a position sensor 94 equipped on the motor 141. For example, the controller 190 may calculate the rotation speed of the motor 141 based on a change in the electrical angle of the rotor for a sampling time interval. The position sensor 94 may be implemented by a hall sensor, an encoder, or a resolver that is able to measure a position of the rotor 143 of the motor 141. Furthermore, the controller 190 may calculate a rotation speed of the motor 141 based on a driving current value measured by the current sensor 91.

The motor 141 may rotate the drum 130 under the control of the controller 190. The controller 190 may drive the motor 141 to follow a target rotation speed.

Specifically, as shown in FIG. 4, the driving circuit 200 may include a rectifying circuit 210 for rectifying AC power from an external power source ES, a DC link circuit 220 for eliminating ripples of the rectified power and outputting DC power, an inverter circuit 230 for converting the DC power to sinusoidal driving power and outputting a driving current $I_{abc}$ to the motor 141, a current sensor 91 for measuring driving currents $I_a$, $I_b$, and $I_c$ applied to the motor 141, a driving controller 250 for controlling driving power conversion of the inverter circuit 230, and a gate driver 260 for turning on or off switching circuits Q1, Q2, Q3, Q4, Q5 and Q6 included in the inverter circuit 230 based on a driving signal from the driving controller 250.

Furthermore, the position sensor 94 for measuring a position (an electrical angle) of the rotor 143 of the motor 141 may be provided on each motor 141.

The rectifying circuit 210 may include a diode bridge including a plurality of diodes D1, D2, D3 and D4. The diode bridge is arranged between a positive terminal P and a negative terminal N of the driving circuit 200. The rectifying circuit 210 may rectify the AC power (AC voltage and AC current) that changes in magnitude and direction over time to power having a constant direction.

The DC link circuit 220 includes a DC link capacitor C for storing electric energy. The DC link capacitor C is arranged between the positive terminal P and the negative terminal N of the driving circuit 200. The DC link circuit 220 may receive the power rectified by the rectifying circuit 210 and output DC power with a constant magnitude and direction.

The inverter circuit 230 may include three pairs of switching devices Q1 and Q2, Q3 and Q4, and Q5 and Q6 arranged between the positive terminal P and the negative terminal N of the driving circuit 200. Specifically, the inverter circuit 230 may include a plurality of upper switching devices Q1, Q3 and Q5 and a plurality of lower switching devices Q2, Q4 and Q6.

The switching device pairs Q1 and Q2, Q3 and Q4, and Q5 and Q6 may each include two switching devices Q1 and Q2, Q3 and Q4, or Q5 and Q6 connected in series. The switching devices Q1, Q2, Q3, Q4, Q5 and Q6 included in the inverter circuit 230 may each be turned on/off by an output of the gate driver 260, so that 3-phase driving current $I_a$, $I_b$, and $I_c$ may be applied to the motor 141.

The current sensor 91 may measure the 3-phase driving current (a-phase current, b-phase current and c-phase current) output from the inverter circuit 230, and output data representing the measured 3-phase driving current value $I_a$, $I_b$, $I_c$: $I_{abc}$ to the driving controller 250. Alternatively, the current sensor 91 may measure only 2-phase driving current among the 3-phase driving current $I_{abc}$, and the driving controller 250 may expect the other phase driving current from the two-phase driving current.

The position sensor 94 may be arranged on the motor 141 for measuring a position Θ (e.g., an electrical angle) of the rotor 143 of the motor 141 and outputting position data representing the electrical angle Θ of the rotor 143. The position sensor 94 may be implemented by a hall sensor, an encoder, a resolver, or the like.

The gate driver 260 may output a gate signal to turn on/off the plurality of switching circuits Q1, Q2, Q3, Q4, Q5 and Q6 included in the inverter circuit 230 based on an output of the driving controller 250.

The driving controller 250 may be provided separately from the controller 190. For example, the driving controller 250 may include an application specific integrated circuit (ASIC) for outputting a driving signal based on e.g., a rotation speed command ω*, the driving current value $I_{abc}$ and the rotor position Θ. Alternatively, the driving controller 250 may include a memory for storing a series of instructions for outputting a driving signal based on the rotation speed command ω*, the driving current value $I_{abc}$, and the rotor position Θ, and a processor for processing the series of instructions stored in the memory.

The driving controller 250 may be provided integrally with the controller 190. For example, the driving controller 250 may be implemented with a series of instructions for outputting a driving signal based on the rotation speed command ω*, the driving current value $I_{abc}$, and the rotor position Θ stored in the memory 192 of the controller 190.

The driving controller 250 may receive a motor control signal (e.g., a rotation speed command) from the controller 190, receive the driving current value $I_{abc}$ from the current sensor 91, and receive the rotor position Θ of the motor 141 from the position sensor 94. The driving controller 250 may determine a driving current value to be applied to the motor 141 based on the rotation speed command ω*, the driving current value $I_{abc}$ and the rotor position Θ, and output a driving signal (pulse width modulation (PWM) signal) for controlling the inverter circuit 230 based on the determined driving current value.

The driving controller 250 may include a speed operator 251, an input coordinate converter 252, a speed controller 253, a current controller 254, an output coordinate converter 255 and a pulse width modulator 256, as shown in FIG. 5.

The speed operator 251 may calculate a rotation speed value ω of the motor 141 based on the electrical angle Θ of the rotor of the motor 141. The electrical angle θ of the rotor may be received from the position sensor 94 arranged on the motor 141. For example, the speed operator 251 may calculate the rotation speed value ω of the motor 141 based on a change in the electrical angle Θ of the rotor 143 for a sampling time interval.

When there is no position sensor 94 provided in an embodiment of the disclosure, the speed operator 251 may calculate the rotation speed value ω of the motor 141 based on the driving current value $I_{abc}$ measured by the current sensor 91.

An input coordinate converter 252 may convert the 3-phase driving current value $I_{abc}$ into d-axis current value $I_d$ and q-axis current value $I_q$ (hereinafter, d-axis current and q-axis current) based on the electrical angle Θ of the rotor. In other words, the input coordinate converter 252 may perform axial conversion on the a-axis, the b-axis, and the c-axis of the 3-phase driving current value $I_{abc}$ into the d-axis and the q-axis. In this case, the d-axis refers to an axis in a direction corresponding to a direction of a magnetic field produced by the rotor of the motor 141, and the q-axis refers to an axis in a direction ahead by 90 degrees of a direction of the magnetic field produced by the rotor of the motor 141. The 90 degrees refer to an electrical angle rather than a mechanical angle of the rotor, and the electrical angle refers to a converted angle according to which an angle between neighboring N poles or neighboring S poles of the rotor is converted into 360 degrees.

Furthermore, the d-axis current may represent a current component of the driving current, which produces a magnetic field in the d-axis direction, and the q-axis current may represent a current component of the driving current, which produces a magnetic field in the q-axis direction.

The input coordinate converter 252 may calculate the q-axis current value $I_q$ and the d-axis current value $I_d$ from the 3-phase driving current value $I_{abc}$ according to a known method.

The speed controller 253 may compare the rotation speed command ω* from the controller 190 with the rotation speed value ω of the motor 141, and output a q-axis current command $I_q$* and a d-axis current command $I_d$* based on a result of the comparing. For example, the speed controller 253 may use proportional integral control (PI control) to calculate the q-axis current command $I_q$* and the d-axis current command $I_d$* to be applied to the motor 141 based on a difference between the rotation speed command ω* and the rotation speed value ω.

The current controller 254 may compare the q-axis current command $I_q$* and the d-axis current command $I_d$* output from the speed controller 253 with the q-axis current value $I_q$ and the d-axis current value $I_d$ output from the input coordinate converter 252, and output a q-axis voltage command $V_q$* and a d-axis voltage command $V_d$* based on a result of the comparing. Specifically, the current controller 254 may use PI control to determine the q-axis voltage command $V_q$* based on a difference between the q-axis current command $I_q$* and the q-axis current value $I_q$ and determine the d-axis voltage command $V_d$* based on a difference between the d-axis current command $I_d$* and the d-axis current value $I_d$.

The output coordinate converter 255 may convert a dq-axis voltage command $V_{dq}$* into 3-phase voltage commands (an a-phase voltage command, a b-phase voltage command, and a c-phase voltage command) $V_{abc}$* based on the electrical angle Θ of the rotor of the motor 141.

The output coordinate converter 255 may convert the dq-axis voltage $V_{dq}$* to the 3-phase voltage command $V_{abc}$* according to a known method.

The pulse width modulator 256 may generate a PWM control signal Vpwm to turn on or turn off the switching circuits Q1, Q2, Q3, Q4, Q5 and Q6 of the inverter circuit 230 from the 3-phase voltage command $V_{abc}$*. Specifically, the pulse width modulator 256 may perform PWM on the 3-phase voltage command $V_{abc}$* and output a PWMed PWM signal Vpwm to the gate driver 260.

As such, the driving controller 250 may output a driving signal (PWM signal) to the gate driver 260 based on a motor control signal (e.g., a rotation speed command) from the controller 190. Furthermore, the driving controller 250 may provide the driving current value $I_{abc}$, the dq-axis current value $I_{dq}$ and the dq-axis current command $I_{dq}$ to the controller 190.

As described above, the driving circuit 200 may apply a driving current to the motor 141 based on a motor control signal (e.g., a rotation speed command or a rotation deceleration command) from the controller 190.

The motor 141 may rotate the drum 130 depending on the driving current from the driving circuit 200. For example, the motor 141 may rotate the drum 130 based on the driving current so that the rotation speed of the drum 130 follows a rotation speed command output from the controller 190.

Furthermore, the motor 141 may decelerate the drum 130 so that the rotation speed of the drum 130 follows a rotation deceleration command output from the controller 190.

The water supply valve 152 may be opened in response to a water supply signal from the controller 190. As the water supply valve 152 is opened, water may be supplied into the tub 120 through the water supply tube 151.

The drain pump 162 may discharge the water out of the cabinet 100 through the drain tube 161 in response to a drain signal from the controller 190. By the operation of the drain pump 162, the water stored in the tub 120 may be discharged out of the cabinet 100 through the drain tube 161.

The vibration sensor 180 may detect vibration of the tub 120. Specifically, the vibration sensor 180 may detect the vibration of the tub 120 caused by rotation of the drum 130 in a laundry cycle (e.g., dehydrating course). Unbalance of clothes placed in the drum 130 may cause eccentricity of the drum 130, which may in turn cause a vibration of the tub 120. When the rotation speed of the motor 141 increases while the layout of the clothes is unbalanced, vibration of the tub 120 and the vibration noise may increase as well.

The vibration sensor 180 may output a vibration signal of the vibration of the tub 120. The amplitude of the vibration signal may be defined as a vibration value of when the tub 120 vibrates. The controller 190 may constantly receive the vibration signal output from the vibration sensor 180 until completion of the laundry cycle, and control the rotation speed of the motor 141 based on the vibration value.

In an embodiment of the disclosure, the controller 190 may convert a vibration signal of the time domain output from the vibration sensor 180 to a vibration signal of the frequency domain, and process the vibration signal of the frequency domain.

In various embodiments of the disclosure, the vibration sensor 180 may be implemented by the driver 140.

Specifically, the driving controller 250 may detect the vibration of the tub 120 indirectly based on a driving current value measured by the current sensor 91 and/or a driving voltage for driving the motor 141 and/or the speed of the rotor 143 measured by the position sensor 94.

The driving controller 250 may determine a vibration value of the tub 120 based on a driving current value measured by the current sensor 91 and/or a driving voltage for driving the motor 141 and/or the speed of the rotor 143 measured by the position sensor 94, and send information about the determined vibration value to the controller 190.

That is, the vibration sensor 180 may be implemented by not only a separate sensor for directly measuring the vibration of the tub 120 but also the driving controller 250 for controlling the motor 141.

In various embodiments of the disclosure, when the controller 190 is integrally formed with the driving controller 250, the vibration sensor 180 may include the current sensor 91 and/or a voltage sensor for measuring a driving voltage to drive the motor 141 and/or the position sensor 94.

The controller 190 may include a processor 191 for generating a control signal for an operation of the washing machine 10, and a memory 192 for storing a program, an application, instructions and/or data for operation of the washing machine 10. The processor 191 and the memory 192 may be implemented with separate semiconductor devices or in a single semiconductor device. Furthermore, the controller 190 may include a plurality of processors or a plurality of memories. The controller 190 may be provided in various positions inside the washing machine 10. For example, the controller 190 may be included in a printed circuit board (PCB) arranged in the control panel 110.

The processor 191 may include an operation circuit, a storage circuit, and a control circuit. The processor 191 may include one or multiple chips. Furthermore, the processor 191 may include one or multiple cores.

The memory 192 may store a program for performing a laundry cycle according to a laundry course and data including a laundry setting according to the laundry course. Furthermore, the memory 192 may store a laundry course and a laundry setting (e.g., a dehydration mode) currently selected based on a user input. In an embodiment of the disclosure, the memory 192 may store a program including an algorithm for performing a laundry cycle according to a laundry course and a laundry setting, an algorithm for restarting a dehydrating course when a vibration value during the dehydrating course exceeds an acceptable standard of vibration to prevent damage to components, an algorithm for changing the acceptable standard of vibration based on the number of times of restarting the dehydrating course, etc., and data about a plurality of acceptable standards of vibration.

The memory 192 may include a volatile memory, such as a static random access memory (S-RAM) or a dynamic RAM (D-RAM), and a non-volatile memory, such as a read only memory (ROM) or an erasable programmable ROM (EPROM). The memory 192 may include a memory device, or multiple memory devices.

The processor 191 may process data and/or a signal based on the program provided from the memory 192, and transmit a control signal to each component of the washing machine 10 based on the processing result. For example, the processor 191 may process a user input received through the control panel 110. The processor 191 may output a control signal to control the motor 141, the water supply valve 152, and the drain pump 162 in response to a user input.

In another example, the processor 191 may use the program provided from the memory 192 to stop the dehydrating course when the vibration value during the dehydrating course exceeds the acceptable standard of vibration and then restart the dehydrating course.

In yet another example, the processor 191 may use the program provided from the memory 192 to change the acceptable standard of vibration based on the number of times of restarting the dehydrating course in a plurality of laundry cycles.

The processor 191 may control the driver 140, the water supply valve 152 and the drain pump 162 to perform a laundry cycle comprised of a washing course, a rinsing course and a dehydrating course. Furthermore, the processor 191 may control the control panel 110 to display a laundry setting and laundry operation information.

The processor 191 may also control the communication device 195 to transmit certain information to an external device.

The communication device 195 may transmit data to the external device or receive data from the external device under the control of the controller 190. For example, the communication device 195 may communicate with a server, a user terminal, and/or a home appliance to transmit or receive various data.

For this, the communication device 195 may support establishment of a direct (e.g., wired) communication channel or a wireless communication channel between external devices (e.g., a server, a user terminal and/or a home appliance), and communication through the established communication channel. According to an embodiment of the disclosure, the communication device 195 may include a wireless communication module (e.g., a cellular communication module, a short-range wireless communication module or a global navigation satellite system (GNSS) communication module) or a wired communication module (e.g., a local area network (LAN) communication module or a power-line communication module). A corresponding one of the communication modules may communicate with an external electronic device over a first network (e.g., a short-range communication network such as bluetooth, wireless-fidelity (Wi-Fi) direct or infrared data association (IrDA)) or a second network (e.g., a remote communication network such as a legacy cellular network, a fifth generation (5G) network, a next generation communication network, the Internet, or a computer network (e.g., a LAN or wide area network (WAN)). These various types of communication modules may be integrated in a single component (e.g., a single chip) or implemented by a plurality of separate components (e.g., a plurality of chips).

In various embodiments of the disclosure, the communication device 195 may establish communication with a user terminal through a server.

In various embodiments of the disclosure, the communication device 195 may include a Wi-Fi module, and perform communication with an external server and/or a user terminal based on establishment of communication with a home access point (AP).

Components of the washing machine 10 have thus far been described, but the washing machine 10 may include more different components within ordinary technologies.

Figure 6:
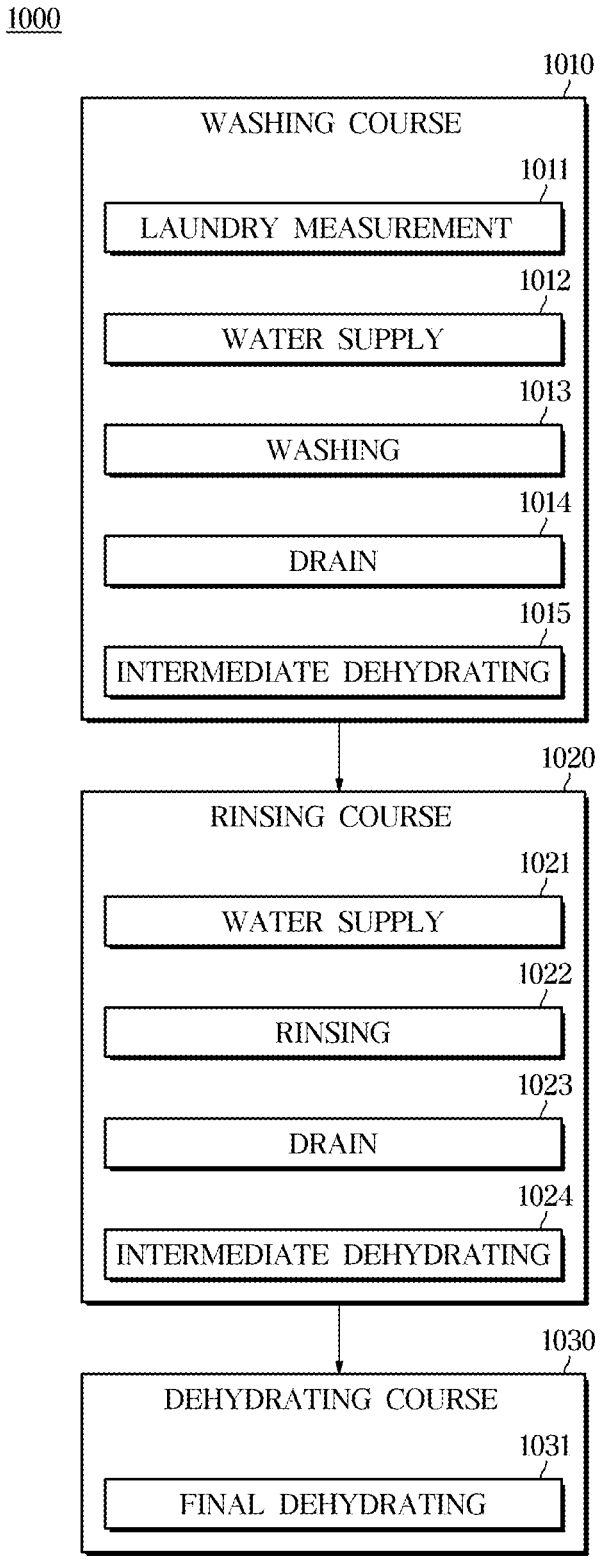
FIG. 6 illustrates an example of a laundry cycle of a washing machine according to an embodiment of the disclosure.

FIG. 6 illustrates an example of a laundry cycle of a washing machine, according to an embodiment of the disclosure.

Referring to FIG. 6, the washing machine 10 may perform a washing course 1010, a rinsing course 1020 and a dehydrating course 1030 sequentially based on a user input to start a laundry cycle 1000.

That is, the laundry cycle 1000 may include a washing course 1010, a rinsing course 1020 and a dehydrating course 1030.

Clothes may be washed by the washing course 1010. Specifically, dirt on the clothes may be separated by chemical actions of a detergent and/or mechanical actions such as falling.

The washing course 1010 may include laundry measurement 1011 for measuring an amount of clothes, water supply 1012 for supplying water into the tub 120, washing 1013 for washing the clothes by rotating the drum 130 at low speed, draining 1014 for draining water contained in the tub 120, and intermediate dehydrating 1015 for separating water from the clothes by rotating the drum 130 at high speed.

For the washing 1013, the controller 190 may control the driving circuit 200 to rotate the motor 141 in forward direction or reverse direction. Due to the rotation of the drum 130, the clothes may be washed by falling down the drum 130.

For the intermediate dehydrating 1015, the controller 190 may control the driving circuit 200 to rotate the motor 141 at high speed. Due to the high-speed rotation of the drum 130, water may be separated from the clothes contained in the drum 130 and drained out of the washing machine 10.

The rotation speed of the drum 130 may gradually increase during the intermediate dehydrating 1015. For example, the controller 190 may control the driving circuit 200 to rotate the motor 141 at a first rotation speed, and control the motor 141 so that the rotation speed of the motor 141 increases to a second rotation speed based on a change in driving current to the motor 141 while the motor 141 is rotating at the first rotation speed. The controller 190 may control the motor 141 so that the rotation speed of the motor 141 increases to a third rotation speed or the rotation speed of the motor 141 decreases to the first rotation speed based on a change in driving current of the motor 141 while the motor 141 is rotated at the second rotation speed.

The clothes may be rinsed by the rinsing course 1020. Specifically, the remnants of the detergent or dirt on the clothes may be washed by water.

The rinsing course 1020 may include water supply 1021 for supplying water into the tub 120, rinsing 1022 for rinsing the clothes by driving the drum 130, draining 1023 for draining water contained in the tub 120, and intermediate dehydrating 1024 for separating water from the clothes by driving the drum 130. The water supply 1021, draining 1023 and intermediate dehydrating 1024 of the rinsing course 1020 may correspond to the water supply 1012, draining 1014 and intermediate dehydrating 1015 of the washing course 1010. During the rinsing course 1020, the water supply 1021, the rinsing 1022, the draining 1023 and the intermediate dehydrating 1024 may be performed one or multiple times.

The clothes may be dehydrated by the dehydrating course 1030. Specifically, water may be separated from the clothes by high-speed rotation of the drum 130, and the separated water may be discharged out of the washing machine 10.

The dehydrating course 1030 may include final dehydrating 1031 to separate water from the clothes by rotating the drum 130 at high speed. With the final dehydrating 1031, the last intermediate dehydrating 1024 of the rinsing course 1020 may be skipped.

The controller 190 may perform a weight detection process for detecting the weight of clothes before the final dehydrating 1031 is started. For example, the controller 190 may control the driver 140 to repeatedly turn on/off the motor 141 to perform the weight detection process and measure the loads (weight of the clothes) in the drum 130 based on the value of counter electromotive force produced when the motor 141 is turned off. In another example, the controller 190 may provide a target speed command to rotate the drum at a first target speed to the driver 140, and measure loads (weight of the clothes) in the drum 130 based on time spent until the drum 130 reaches the first target speed.

For the final dehydrating 1031, the controller 190 may control the driving circuit 200 to rotate the motor 141 at high speed. Due to the high-speed rotation of the drum 130, water may be separated from the clothes contained in the drum 130 and drained out of the washing machine 10. The rotation speed of the motor 141 may gradually increase.

As the operation of the washing machine 10 is completed with the final dehydrating 1031, performance time of the final dehydrating 1031 may be longer than performance time of the intermediate dehydrating 1015 or 1024.

As described above, the washing machine 10 may perform a laundry cycle to do the laundry. During the intermediate dehydrating 1015 and 1024 and the final dehydrating 1031 in particular, the washing machine 10 may gradually increase the rotation speed of the motor 141 for rotating the drum 130, and increase or decrease the rotation speed of the motor 141 based on a change in driving current to the motor 141.

The dehydrating course as mentioned throughout the specification may refer to all of the intermediate dehydrating 1015 performed in the washing course 1010, the intermediate dehydrating 1024 performed in the rinsing course 1020, and the final dehydrating 1031 performed in the dehydrating course 1030, but in the following description, the dehydrating course is assumed to be the final dehydrating 1031 in the dehydrating course 1030 performed after the rinsing course 1020.

Furthermore, in the disclosure, one laundry cycle 1000 may refer to a cycle in which the washing course 1010, the rinsing course 1020 and the dehydrating course 1030 are sequentially performed.

For example, the laundry cycle 1000 may be started based on a user input, and terminated based on the completion of the dehydrating course 1030.

Figure 7:
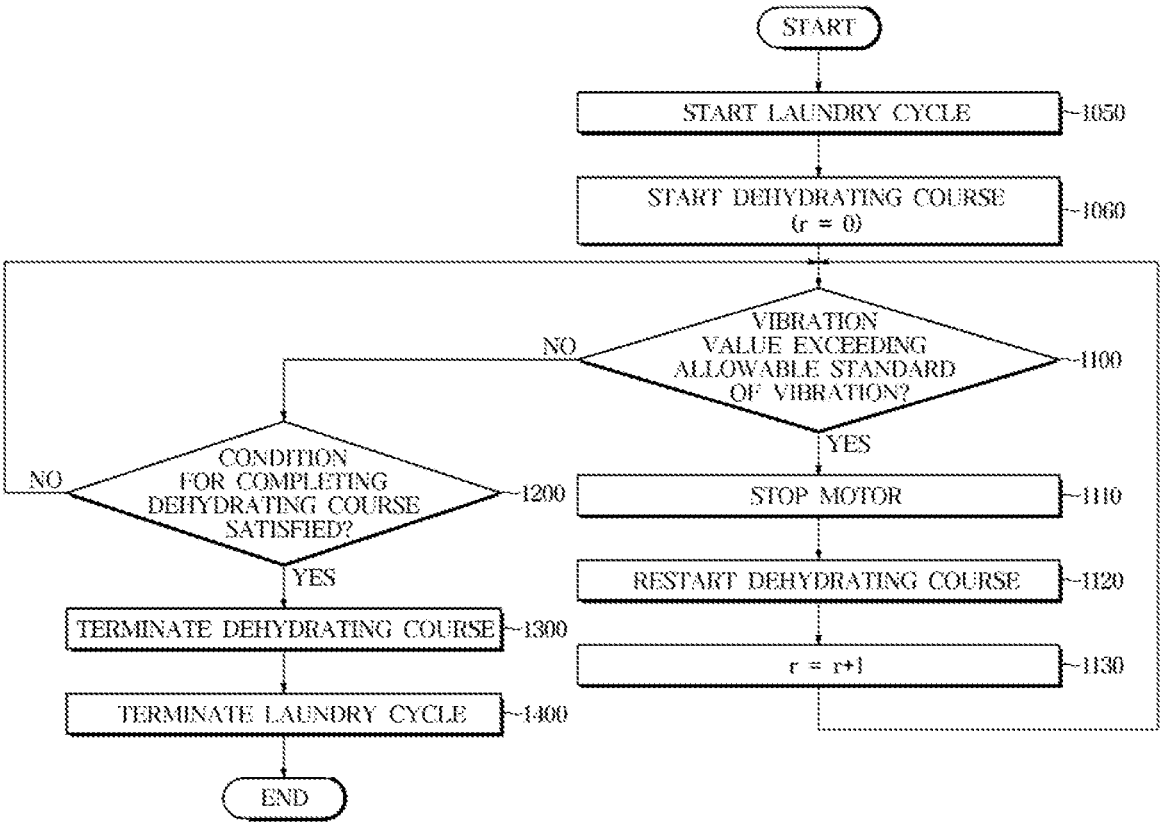
FIG. 7 is a flowchart illustrating a procedure in which a washing machine restarts a dehydrating course in one laundry cycle according to an embodiment of the disclosure.

FIG. 7 is a flowchart illustrating a procedure in which a washing machine restarts a dehydrating course in a laundry cycle, according to an embodiment of the disclosure.

Referring to FIG. 7, the controller 190 may start a laundry cycle in response to reception of a user input to start the laundry cycle, in 1050.

The user may input a user input to start the laundry cycle through the control panel 110 or remotely through a user terminal.

For example, the controller 190 may start the laundry cycle in response to reception of a user input to start the laundry cycle through the control panel 110. Furthermore, the controller 190 may start the laundry cycle in response to reception of a user input to start the laundry cycle from a user terminal (or a relay server) through the communication device 195.

The controller 190 may proceed the laundry cycle based on a laundry course and/or a laundry setting. For example, the memory 192 may store an algorithm for operating various components of the washing machine 10 to correspond to the laundry course and/or the laundry setting, and the processor 191 may proceed the laundry cycle based on the algorithm stored in the memory 192.

The controller 190 may start a dehydrating course based on completion of a rinsing course, in 1060.

When the dehydrating course is started for the first time in the laundry cycle, the number (r) of times of restarting the dehydrating course may be counted as 0.

The time when the dehydrating course is started for the first time refers to a time to start the first dehydrating course in the laundry cycle and not a time to restart the dehydrating course.

The controller 190 may determine whether a vibration value measured by the vibration sensor 180 exceeds an acceptable standard of vibration during the dehydrating course, in 1100.

The acceptable standard of vibration may include a plurality of acceptable standards of vibration applied depending on the time passed from the time when the dehydrating course is started for the first time.

For example, the acceptable standards of vibration may include a first acceptable standard of vibration applied when a first preset time (e.g., about 8 minutes) has passed from the time when the dehydrating course is started for the first time, a second acceptable standard of vibration applied when the first preset time is passed but a second preset time (e.g., about 12 minutes) has not passed from the time when the dehydrating course is started for the first time, and/or a third acceptable standard of vibration applied when the second preset time has passed from the time when the dehydrating course is started for the first time.

In various embodiments of the disclosure, the controller 190 may restart the dehydrating course based on the vibration value exceeding the first acceptable standard of vibration when the first preset time is not passed from when the dehydrating course is started for the first time, restart the dehydrating course based on the vibration value exceeding the second acceptable standard of vibration when the first preset time is passed but the second preset time is not passed from when the dehydrating course is started for the first time, and restart the dehydrating course based on the vibration value exceeding the third acceptable standard of vibration when the second preset time is passed from when the dehydrating course is started for the first time.

The plurality of acceptable standards of vibration (e.g., the first acceptable standard of vibration, the second acceptable standard of vibration and/or the third acceptable standard of vibration) may each be set to one of a first standard, a second standard and a third standard.

The first standard, the second standard, and the third standard may be stored in the memory.

Each of the first standard, the second standard and the third standard may include vibration limit values that vary according to the weight of the clothes and/or a dehydration section.

For example, the first standard may include a plurality of first vibration limit values corresponding to the plurality of sections of the dehydrating course, the second standard may include a plurality of second vibration limit values corresponding to the plurality of sections of the dehydrating course, and the third standard may include a plurality of third vibration limit values corresponding to the plurality of sections of the dehydrating course.

For example, the plurality of first vibration limit values may include a vibration limit value 1-1 corresponding to a first section of the dehydrating course, a vibration limit value 1-2 corresponding to a second section of the dehydrating course, and/or a vibration limit value 1-m corresponding to an m-th section of the dehydrating course, where m is a natural number equal to or greater than 3.

Similarly, the plurality of second vibration limit values may include a vibration limit value 2-1 corresponding to the first section of the dehydrating course, a vibration limit value 2-2 corresponding to the second section of the dehydrating course, and/or a vibration limit value 2-m corresponding to the m-th section of the dehydrating course.

The plurality of third vibration limit values may include a vibration limit value 3-1 corresponding to the first section of the dehydrating course, a vibration limit value 3-2 corresponding to the second section of the dehydrating course, and/or a vibration limit value 3-m corresponding to the m-th section of the dehydrating course.

The first standard, the second standard, and the third standard may be classified according to the degree of suppressing vibration caused in the tub 120.

For example, the first standard may be a strict standard focused to suppress vibrations occurring in the tub 120, the third standard may be a relaxed standard focused to reduce time spent for the dehydrating course, and the second standard may be a standard intermediate between the first standard and the third standard. In an embodiment of the disclosure, under the same conditions (e.g., weight of the clothes), an average of the plurality of first vibration limit values included in the first standard may be smaller than an average of the plurality of second vibration limit values included in the second standard, and the average of the plurality of second vibration limit values included in the second standard may be smaller than an average of the plurality of third vibration limit values included in the third standard.

In various embodiments of the disclosure, when the number (r) of times of restarting the dehydrating course in one laundry cycle exceeds a threshold, the controller 190 may forcibly terminate the laundry cycle.

Furthermore, when the number of times of restarting the dehydrating course in one laundry cycle exceeds the threshold, the controller 190 may control the display 111, a speaker and/or the communication device 195 to notify the user that eccentricity due to the clothes is not relieved.

Figure 8:
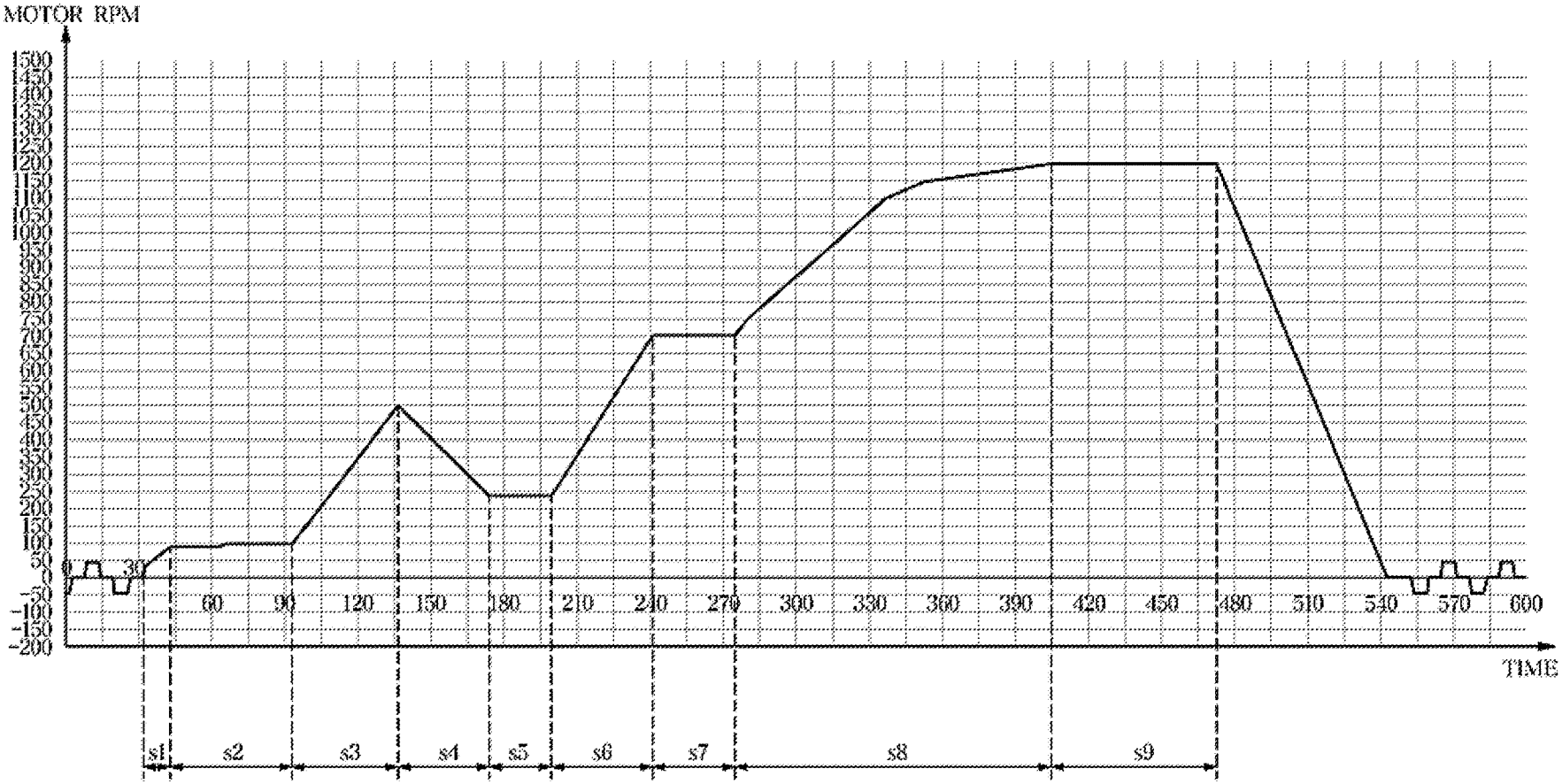
FIG. 8 is a graph representing changes in speed of a motor during a dehydrating course according to an embodiment of the disclosure.

FIG. 8 is a graph representing changes in speed of a motor during a dehydrating course.

Referring to FIG. 8, the first section in the dehydrating course may include section s1 to accelerate the motor 141 to a first rotation speed, and the second section in the dehydrating course may include section s2 to maintain the motor at the first rotation speed. Definitions of the first section and the second section are not, however, limited thereto.

For example, the dehydrating course may include various sections such as the section s1 to accelerate the motor 141 to the first rotation speed, the section s2 to maintain the motor 141 at the first rotation speed, section s3 to accelerate the motor to a second rotation speed from the first rotation speed, section s4 to decelerate the motor 141 to a third rotation speed from the second rotation speed, section s5 to maintain the motor at the third rotation speed, section s6 to accelerate the motor 141 to a fourth rotation speed from the third rotation speed, section s7 to maintain the motor 141 at the fourth rotation speed, section s8 to accelerate the motor 141 to a fifth rotation speed from the fourth rotation speed, section s9 to maintain the motor 141 at the fifth rotation speed, etc.

To sum up, the acceptable standard of vibration may not include one standard but may include a plurality of standards that change according to the time passed from a point in time at which the dehydrating course is started. Accordingly, the acceptable standard of vibration may not include one vibration limit value but may include a plurality of vibration limit values that change in each section of the dehydrating.

When it is assumed that the acceptable standard of vibration has vibration limit value p in the first section in the dehydrating course and vibration limit value q in the second section in the dehydrating course, the controller 190 may stop the motor based on the vibration value measured by the vibration sensor 180 exceeding the vibration limit value p in the first section of the dehydrating course, and stop the motor based on the vibration value measured by the vibration sensor 180 exceeding the vibration limit value q in the second section of the dehydrating course.

The controller 190 may stop the motor based on the vibration value measured by the vibration sensor 180 exceeding the acceptable standard of vibration, in 1110. Specifically, when the vibration value measured by the vibration sensor 180 exceeds the acceptable standard of vibration, the controller 190 may completely stop the motor 141 to prevent reduction in dehydration efficiency due to unbalanced layout of the clothes and prevent components of the washing machine 10 from being damaged due to the vibration or prevent occurrences of excessive vibration.

The controller 190 may restart a dehydrating course based on the stopping of the motor 141, in 1120. When the dehydrating course is restarted, the number (r) of times of restarting the dehydrating course may be counted, in 1130.

In other words, the number (r) of times of stopping the motor 141 and restarting the dehydrating course in one laundry cycle may be counted, and the number (r) of times of restarting the dehydrating course may be stored in the memory 192.

The controller 190 may terminate the dehydrating course in 1300 based on a condition for completing the dehydrating course being satisfied in 1200.

For example, the controller 190 may terminate the dehydrating course based on the passage of a certain time after the dehydrating course is started or restarted.

In another example, the controller 190 may terminate the dehydrating course based on the speed of the motor 141 reaching a target speed after the dehydrating course is started or restarted.

In yet another example, the controller 190 may terminate the dehydrating course based on the speed of the motor 141 maintained at the target speed for a certain time after the dehydrating course is started or restarted.

The condition for completing the dehydrating course is not, however, limited thereto, and the controller 190 may determine whether the condition for completing the dehydrating course is satisfied based on various algorithms.

The controller 190 may terminate the laundry cycle based on completion of the dehydrating course, in 1400.

When the laundry cycle is terminated, data about the number (r) of times of restarting the dehydrating course in the laundry cycle may be stored in the memory 192.

In various embodiments of the disclosure, the controller 190 may control the control panel 110 to output a visual indication notifying completion of the laundry cycle based on the completion of the laundry cycle. Furthermore, the controller 190 may control the speaker (not shown) to output sound notifying completion of the laundry cycle based on the completion of the laundry cycle. Moreover, the controller 190 may control the communication device 195 to transmit a message notifying completion of the laundry cycle to a user terminal based on the completion of the laundry cycle.

Figure 9:
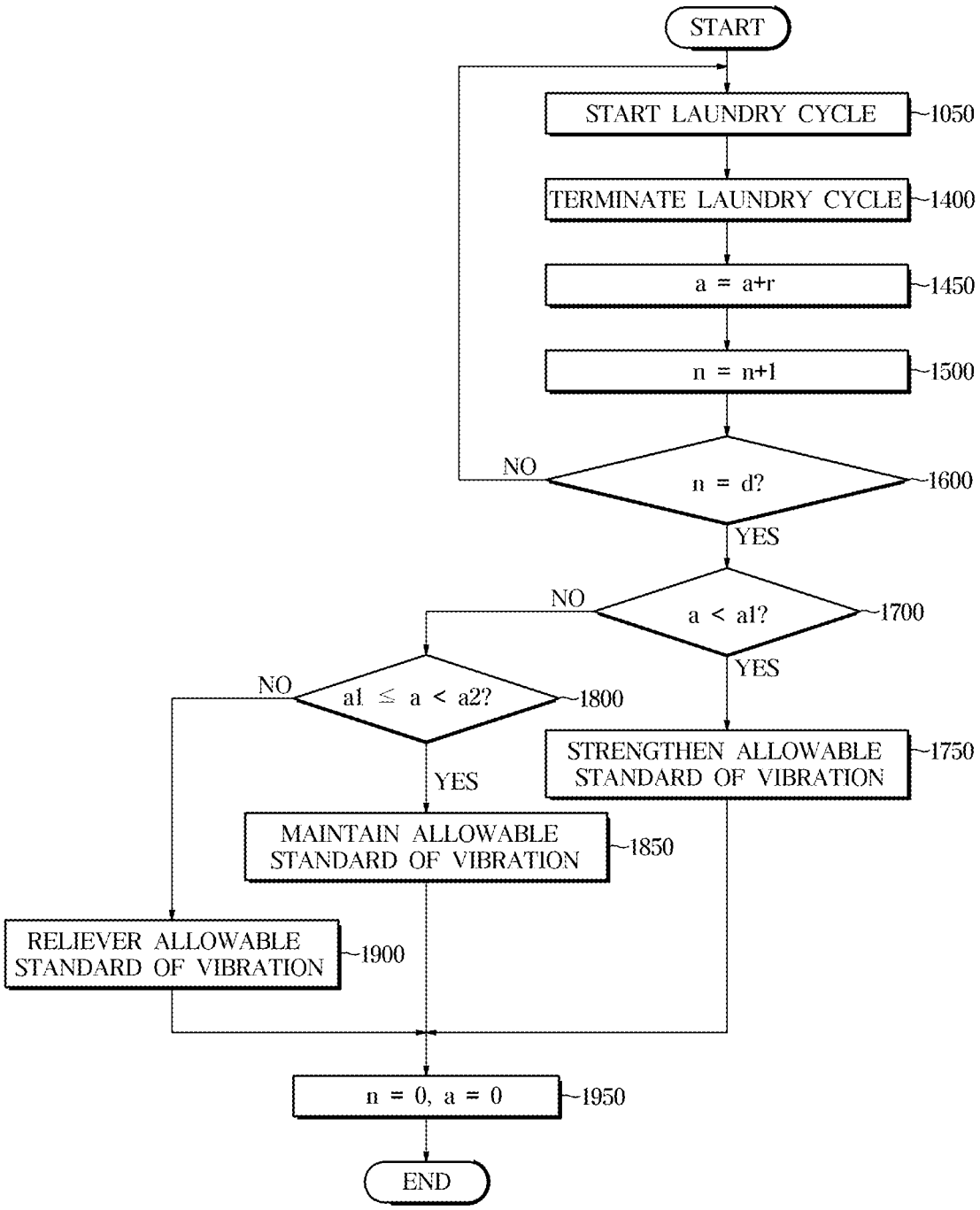
FIG. 9 is a flowchart illustrating a method of controlling a washing machine, according to an embodiment of the disclosure.

FIG. 9 is a flowchart illustrating a method of controlling a washing machine, according to an embodiment of the disclosure.

Referring to FIG. 9, as described above in connection with FIG. 7, the washing machine 10 may start a laundry cycle based on a user input in 1050, and terminate the laundry cycle based on a condition satisfied for completion of the laundry cycle in 1400.

As described above, when one laundry cycle is completed, the number (r) of times of restarting the dehydrating course in the laundry cycle may be stored in the memory 192.

In an embodiment of the disclosure, the memory 192 may store the number (a) of times of restarting the dehydrating course during n laundry cycles, in 1450.

For example, the memory 192 may accumulate the number of times of restarting the dehydrating course in a plurality of laundry cycles by adding the number (r) of times of restarting the dehydrating course in the laundry cycle in question to the number (a) of times of restarting the dehydrating course in the previous laundry cycles.

The controller 190 may accumulate and count the number (n) of times of completing laundry cycles whenever one laundry cycle is started and completed, in 1500.

For example, when 10 laundry cycles are completed, a value of n=10 may be stored.

The controller 190 may accumulate the number (a) of times of restarting the dehydrating course based on the number (n) of times of completing the laundry cycle not reaching a preset number (d) in 1600.

In other words, the controller 190 may count the number of times of restarting the dehydrating course until the preset number (d) of laundry cycles are done.

The present number (d) may be set to more than one to figure out laundry habits of the user. For example, the preset number (d) of times may be set to about 30, without being limited thereto.

When the preset number (d) of laundry cycles are completed in 1600, the controller 190 may change the acceptable standard of vibration based on the number (a) of times of restarting the dehydrating course in the preset number (d) of laundry cycles.

In other words, the controller 190 may change the acceptable standard of vibration based on the number (a) of times of restarting the dehydrating course in (d) laundry cycles.

For example, the controller 190 may determine the number of times of restarting the dehydrating course in one laundry cycle based on the number (a) of times of restarting the dehydrating course and the number (d) of times of completing the laundry cycle, and change the acceptable standard of vibration based on the number of times of restarting the dehydrating course in one laundry cycle on average.

Changing the acceptable standard of vibration based on dehydration time that corresponds to a period from a point in time at which the dehydrating course is started for the first time to a point in time at which the dehydrating course is terminated is not robust to various conditions (e.g., the pause of the laundry cycle in response to a user input and/or the stopping of the dehydrating course due to other factors than the vibration value).

According to the disclosure, an acceptable standard of vibration that is more reliable may be selected by changing the acceptable standard of vibration based on the number of times of restarting the dehydrating course.

FIG. 10 illustrates an example of a table representing a plurality of acceptable standards of vibration.

Referring to FIG. 10, the example of the table regarding the plurality of acceptable standards of vibration may be stored in the memory 192.

As described above, the plurality of acceptable standards of vibration may be classified according to the degree of suppressing vibration of the tub 120.

For example, in FIG. 10, an acceptable standard of vibration of level 1 is a standard having the highest degree of suppressing the vibration of the tub 120, and an acceptable standard of vibration of level 5 is a standard having the lowest degree of suppressing the vibration of the tub 120.

The acceptable standards of vibration may include a first acceptable standard of vibration, a second acceptable standard of vibration and a third acceptable standard of vibration classified according to time t passed from a point in time at which the dehydrating course is started for the first time (hereinafter, elapsed time).

For example, the acceptable standards of vibration may include the first acceptable standard of vibration set when the elapsed time t is less than a preset first time t1, the second acceptable standard of vibration set when the elapsed time t is equal to or more than the first preset time t1 and less than a second preset time t2, and the third acceptable standard of vibration set when the elapsed time t is equal to or greater than the second preset time t2.

Each of the plurality of acceptable standards of vibration (e.g., acceptable standards of vibration of level 1 to level 5) may include at least one of a first standard, a second standard or a third standard.

For example, for the acceptable standard of vibration of level 1, the first standard, the first standard and the third standard may be set as the first acceptable standard of vibration, the second acceptable standard of vibration and the third acceptable standard of vibration, respectively.

In another example, for the acceptable standard of vibration of level 2, the first standard, the second standard and the third standard may be set as the first acceptable standard of vibration, the second acceptable standard of vibration and the third acceptable standard of vibration, respectively.

As described above, an average of the plurality of first vibration limit values included in the first standard may be smaller than an average of the plurality of second vibration limit values included in the second standard, and the average of the plurality of second vibration limit values included in the second standard may be smaller than an average of the plurality of third vibration limit values included in the third standard.

For example, assuming that the plurality of first vibration limit values corresponding to the plurality of sections s1 to s9 of the dehydrating course are defined to be {b1, b2, b3, b4, b5, b6, b7, b8, b9}, the plurality of second vibration limit values corresponding to the plurality of sections s1 to s9 of the dehydrating course are defined to be {c1, c2, c3, c4, c5, c6, c7, c8, c9} and the plurality of third vibration limit values corresponding to the plurality of sections s1 to s9 of the dehydrating course are defined to be {d1, d2, d3, d4, d5, d6, d7, d8, d9}, a sum of b1 to b9 is smaller than a sum of c1 to c9, and the sum of c1 to c9 is smaller than a sum of d1 to d9.

Accordingly, an average of the plurality of vibration limit values included in the acceptable standard of vibration of level 1 is smaller than an average of the plurality of vibration limit values included in the acceptable standard of vibration of level 2, and the average of the plurality of vibration limit values included in the acceptable standard of vibration of level 2 is smaller than an average of the plurality of vibration limit values included in the acceptable standard of vibration of level 3.

That is, the average of the plurality of vibration limit values included in the acceptable standard of vibration increases toward the acceptable standard of vibration of level 5 from the acceptable standard of vibration of level 1.

In an embodiment of the disclosure, the controller 190 may strengthen the acceptable standard of vibration in 1750 based on the number (a) of times of restarting the dehydrating course being smaller than a preset first value (a1) in 1700.

Specifically, the controller 190 may reduce the average of the plurality of vibration limit values included in the acceptable standard of vibration based on the number (a) of times of restarting the dehydrating course being smaller than the preset first value (a1) in 1700. For example, the preset first value may be set to 4×d.

For example, the controller 190 may reduce the level of the acceptable standard of vibration by one step based on the number (a) of times of restarting the dehydrating course being smaller than the preset first value (a1) in 1700.

In an embodiment of the disclosure, when the number (a) of times of restarting the dehydrating course is small as a result of proceeding a plurality (d) of laundry cycles by applying an acceptable standard of vibration of a certain level (e.g., level 2), the controller 190 may apply, from the next laundry cycle, an acceptable standard of vibration with a level reduced by one step.

That is, the controller 190 may change the acceptable standard of vibration by changing at least one of the first acceptable standard of vibration, the second acceptable standard of vibration or the third acceptable standard of vibration.

For example, the controller 190 may change the acceptable standard of vibration of level 2 to the acceptable standard of vibration of level 1 by changing the second acceptable standard of vibration from the second standard to the first standard.

When the preset first value is set to 4×d, the controller 190 may strengthen the acceptable standard of vibration when the number of times of restarting the dehydrating course is smaller than 4 on average in one laundry cycle.

When the average of the plurality of vibration limit values included in the vibration acceptable standard is reduced, the number of times of restarting the dehydrating course may increase even when the vibration occurring in the tub 120 is weak. This may relieve the vibration occurring in the tub 120 but increase the time for dehydration.

When the number (a) of times of restarting the dehydrating course after completion of multiple (d) laundry cycles is smaller than the preset first value a1, it may be estimated that the user has laundry habits of usually washing clothes that do not cause large eccentricity.

Accordingly, in the disclosure, the vibration occurring in the tub 120 may be minimized even when the user unusually washes clothes that cause large eccentricity.

In an embodiment of the disclosure, the controller 190 may maintain the acceptable standard of vibration in 1850 based on the number (a) of times of restarting the dehydrating course equal to or greater than the preset first value a1 in 1700 and smaller than a preset second value (a2) in 1800.

Specifically, the controller 190 may maintain the average of the plurality of vibration limit values included in the acceptable standard of vibration based on the number (a) of times of restarting the dehydrating course equal to or greater than the preset first value a1 in 1700 and smaller than the preset second value (a2) in 1800.

For example, the controller 190 may maintain the level of the acceptable standard of vibration based on the number (a) of times of restarting the dehydrating course equal to or greater than the preset first value a1 in 1700 and smaller than the preset second value (a2) in 1800. For example, the preset second value may be set to 5×d.

In an embodiment of the disclosure, the controller 190 may relieve the acceptable standard of vibration in 1900 based on the number (a) of times of restarting the dehydrating course being equal to or greater than the preset second value (a2) in 1800.

Specifically, the controller 190 may increase the average of the plurality of vibration limit values included in the acceptable standard of vibration based on the number (a) of times of restarting the dehydrating course being equal to or greater than the preset second value (a2) in 1800.

For example, the controller 190 may increase the level of the acceptable standard of vibration by one step based on the number (a) of times of restarting the dehydrating course being equal to or greater than the preset second value (a2) in 1800.

That is, the controller 190 may change the acceptable standard of vibration by changing at least one of the first acceptable standard of vibration, the second acceptable standard of vibration or the third acceptable standard of vibration.

For example, the controller 190 may change the acceptable standard of vibration of level 2 to the acceptable standard of vibration of level 3 by changing the first acceptable standard of vibration from the first standard to the second standard.

When the average of the plurality of vibration limit values included in the vibration acceptable standard increases, the number of times of restarting the dehydrating course may be reduced even with strong vibration occurring in the tub 120. This may reduce the dehydration time but may cause a little vibration in the tub 120.

When the number (a) of times of restarting the dehydrating course after completion of multiple (d) laundry cycles is equal to or greater than the preset second value (a2), it may be estimated that the user has laundry habits of usually washing clothes that cause large eccentricity.

Accordingly, in the disclosure, the dehydration time may be reduced even when the user washes clothes that cause large eccentricity as usual.

Specifically, when the number (a) of times of restarting the dehydrating course is large as a result of proceeding multiple (d) laundry cycles by applying an acceptable standard of vibration of a certain level (e.g., level 2), an acceptable standard of vibration with a level increased by one step may be applied from the next laundry cycle.

The controller 190 may initialize the number (n) of times of completing the laundry cycle and the number (a) of times of restarting the dehydrating course based on the completion of the multiple (d) laundry cycles, in 1950.

Accordingly, the changed acceptable standard of vibration may be applied until the multiple (d) laundry cycles are completed from the next laundry cycle.

When the changed acceptable standard of vibration is applied and new multiple (d) laundry cycles are completed, whether to change the acceptable standard of vibration may be determined based on the newly accumulated number (a) of times of restarting the dehydrating course.

According to the disclosure, by dynamically changing the acceptable standard of vibration according to the number of times of restarting the dehydrating course during the multiple laundry cycles, an optimal acceptable standard of vibration may be applied based on the user's laundry habits, a condition of installing the washing machine 10, a product state, etc.

Furthermore, according to the disclosure, by dynamically changing the acceptable standard of vibration according to the number of times of restarting the dehydrating course, a difference between an expected completion time and an actual completion time of the laundry cycle may be minimized.

Moreover, according to the disclosure, with a plurality of acceptable vibration conditions, each of which is classified according to the elapsed time t, the eccentricity caused by the laundry may be dynamically dealt with.

For example, when one acceptable vibration condition is not classified according to the elapsed time t, and the eccentricity caused by the laundry is not relieved with the one acceptable vibration condition applied, the dehydration time may be lengthened infinitely and the laundry cycle may be terminated because of an error caused by the increasing dehydration time.

According to the disclosure, infinite lengthening of the dehydration time or termination of the laundry cycle due to the increase in dehydration time may be prevented by applying the second acceptable standard of vibration when the vibration value continues to exceed the first acceptable standard of vibration and the dehydration time becomes long, and applying the third acceptable standard of vibration when the vibration value continues to exceed the second acceptable standard of vibration and the dehydration time becomes long.

For this, an average of the plurality of vibration limit values included in the first acceptable standard of vibration may be set to an average of the plurality of vibration limit values included in the second acceptable standard of vibration or less, and an average of the plurality of vibration limit values included in the second acceptable standard of vibration may be set to an average of the plurality of vibration limit values included in the third acceptable standard of vibration or less.

Figure 11:
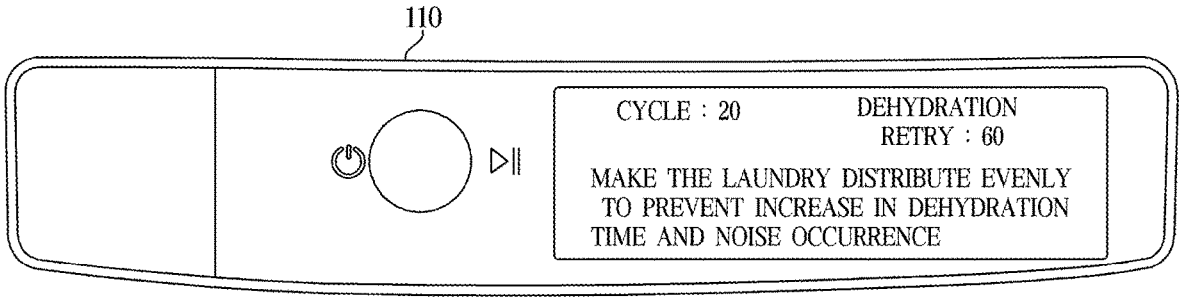
FIG. 11 illustrates an example of a screen notifying a state of a dehydrating course according to an embodiment of the disclosure.

FIG. 11 illustrates an example of a screen notifying a state of a dehydrating course.

Referring to FIG. 11, the controller 190 may control the display 111 to output at least one of a visual indication indicating the number of times of restarting the dehydrating course or a message corresponding to the number of times of restarting the dehydrating course.

For example, the controller 190 may control the display 111 to output the visual indication and/or the message based on completion of the laundry cycle.

In an embodiment of the disclosure, the memory may store a message corresponding to a ratio of the number (a) of times of restarting the dehydrating course and the number (n) of times of completing the laundry cycle.

When the number (a) of times of restarting the dehydrating course is excessive as compared to the number (n) of times of completing the laundry cycle, e.g., when the number (n) of completing the laundry cycle/the number (a) of times of restarting the dehydrating course is larger than the number (n) of times of completing the laundry cycle/the preset second value (a2), the controller 190 may control the display 111 to output a message "make the laundry distribute evenly to prevent increase in dehydration time and noise occurrence".

Furthermore, the controller 190 may control the display 111 to output a visual indication indicating the number (n) of completing the laundry cycle and the number (a) of times of restarting the dehydrating course.

According to the disclosure, information about the state of the dehydrating course may be notified to the user through the display 111, so that the user may be prompted to take proper actions depending on a state of the dehydrating course.

Figure 12:
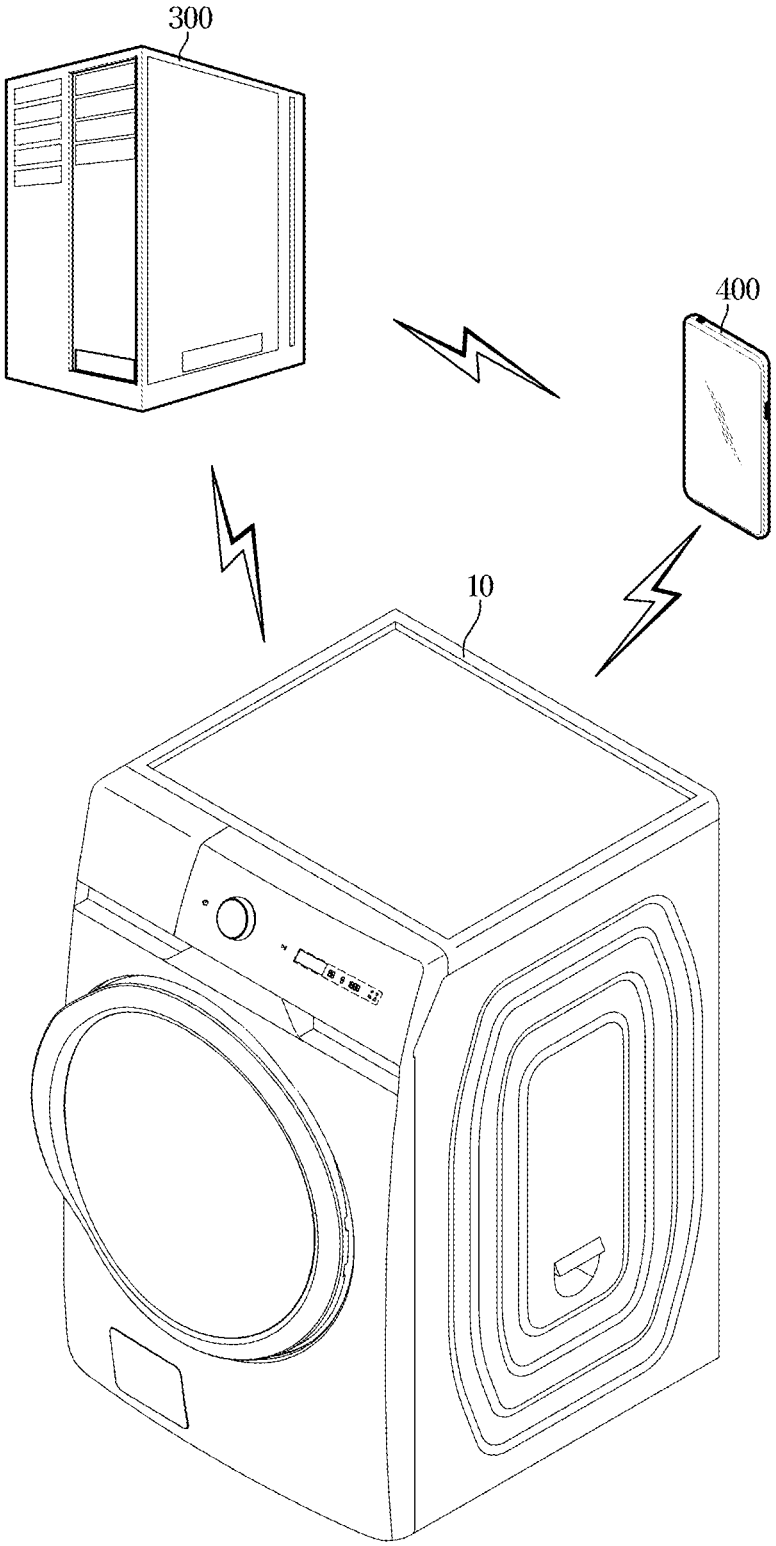
FIG. 12 illustrates a washing machine communicating with external devices according to an embodiment of the disclosure.

FIG. 12 illustrates a washing machine communicating with external devices, according to an embodiment of the disclosure.

Referring to FIG. 12, the washing machine 10 may communicate with an external server 300 and/or a user terminal 400.

For example, the washing machine 10 may communicate with the user terminal 400 by using the external server 300 as a medium.

The controller 190 may control the communication device 195 to transmit information about the number (a) of times of restarting the dehydrating course to the external device (e.g., the external server 300 and/or the user terminal 400). In various embodiments of the disclosure, upon reception of the information about the number (a) of times of restarting the dehydrating course from the washing machine 10, the user terminal 400 may output a visual indication corresponding to the information about the number (a) of times of restarting the dehydrating course.

For example, when the number (a) of times of restarting the dehydrating course is excessive as compared to the number (n) of times of completing the laundry cycle, e.g., when the number (n) of completing the laundry cycle/the number (a) of times of restarting the dehydrating course is larger than the number (n) of times of completing the laundry cycle/the preset second value (a2), the user terminal 400 may output a message "make the laundry distribute evenly to prevent increase in dehydration time and noise occurrence".

Furthermore, the user terminal 400 may output a visual indication indicating the number (n) of times completing the laundry cycle and the number (a) of times of restarting the dehydrating course.

According to the disclosure, information about the state of the dehydrating course may be notified to the user through the user terminal 400, so that the user may be prompted to take proper actions depending on a state of the dehydrating course.

Figure 13:
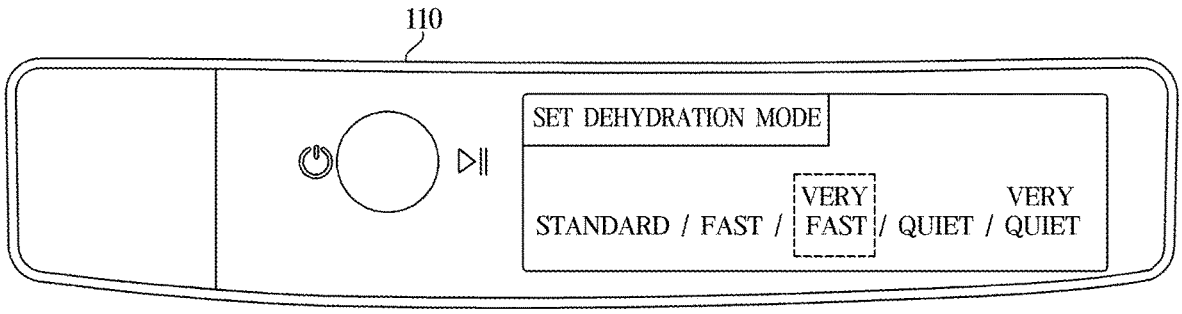
FIG. 13 illustrates an example of a user interface for setting a dehydration mode according to an embodiment of the disclosure.

FIG. 13 illustrates an example of a user interface for setting a dehydration mode.

Referring to FIG. 13, the controller 190 may provide a user interface for setting a dehydration mode through the control panel 110.

The user may set a dehydration mode by manipulating the control panel 110. The dehydration mode may correspond to the acceptable standard of vibration.

For example, when the dehydration mode is set to a first mode (e.g., 'very fast' mode) based on the user input, the controller 190 may change the acceptable standard of vibration applied to the dehydrating course in the current laundry cycle to the acceptable standard of vibration of level 5, when the dehydration mode is set to a second mode (e.g., 'fast' mode), the controller 190 may change the acceptable standard of vibration applied to the dehydrating course in the current laundry cycle to the acceptable standard of vibration of level 4, when the dehydration mode is set to a third mode (e.g., 'standard' mode), the controller 190 may change the acceptable standard of vibration applied to the dehydrating course in the current laundry cycle to the acceptable standard of vibration of level 3, when the dehydration mode is set to a fourth mode (e.g., 'quiet' mode), the controller 190 may change the acceptable standard of vibration applied to the dehydrating course in the current laundry cycle to the acceptable standard of vibration of level 2, and when the dehydration mode is set to a fifth mode (e.g., 'very quiet' mode), the controller 190 may change the acceptable standard of vibration applied to the dehydrating course in the current laundry cycle to the acceptable standard of vibration of level 1.

That is, the control panel 110 may receive a user input to change the acceptable standard of vibration, and the controller 190 may change the acceptable standard of vibration based on the user input.

According to the disclosure, the user may change a mode of the dehydrating course to fit his/her environment. For example, the user may select the 'very quiet' mode to minimize noise occurrence when the user has to do the laundry in the early hours of the morning, and select the 'very fast' mode to rapidly do the laundry even though enduring noise occurrences when the user has to do the laundry to go out.

Figure 14:
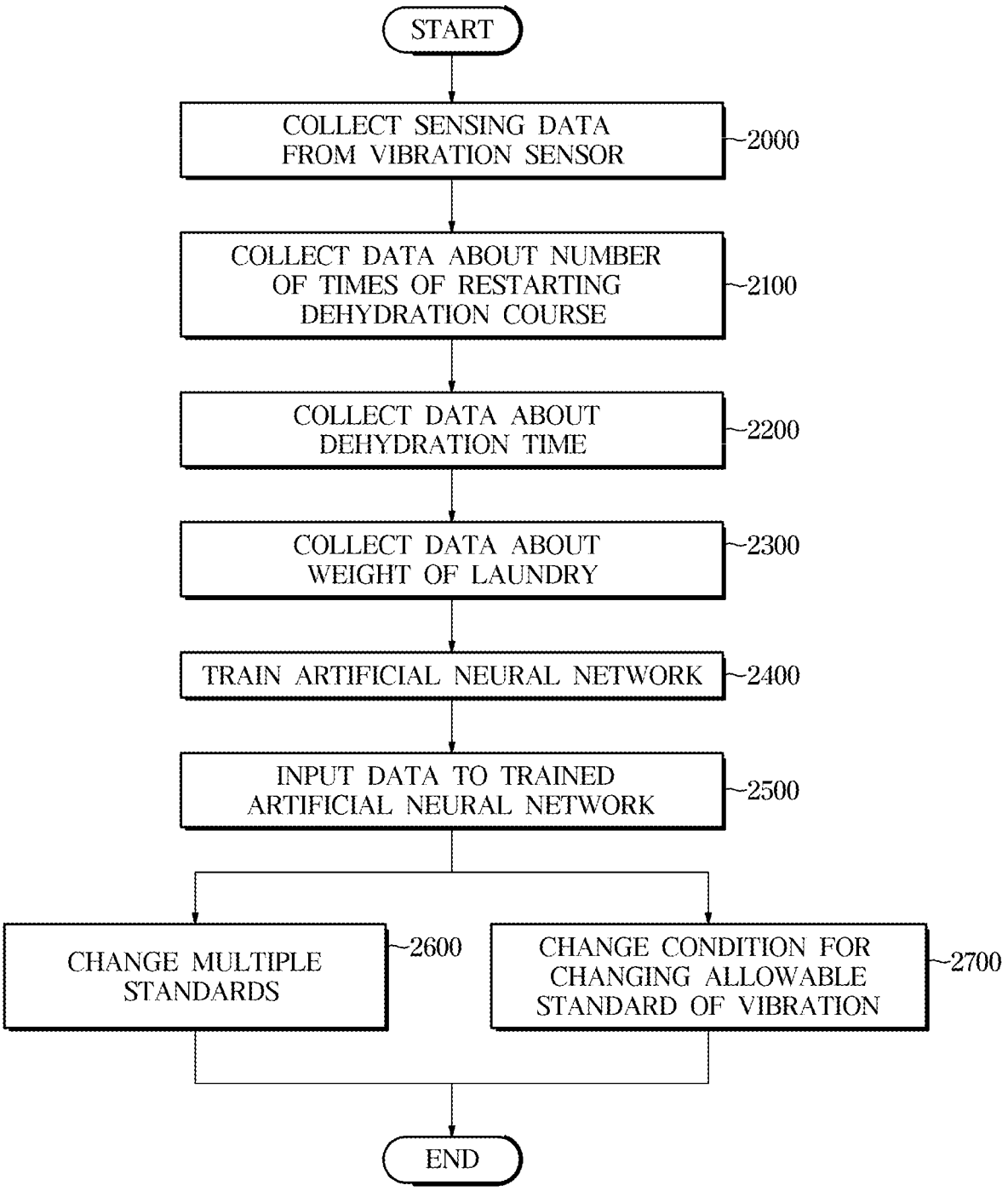
FIG. 14 is a flowchart illustrating a method by which a washing machine determines an optimal acceptable standard of vibration and an optimal condition for changing an acceptable standard of vibration through machine learning according to an embodiment of the disclosure.
Figure 15:
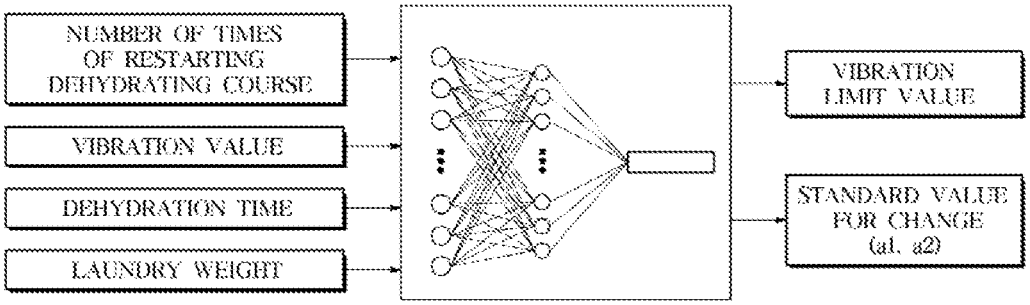
FIG. 15 schematically illustrates input data and output data of an artificial neural network according to an embodiment of the disclosure.

FIG. 14 is a flowchart illustrating a method by which a washing machine determines an optimal acceptable standard of vibration and an optimal condition for changing an acceptable standard of vibration through machine learning, according to an embodiment of the disclosure, and FIG. 15 schematically illustrates input data and output data of an artificial neural network.

Referring to FIG. 14, the controller 190 may collect sensing data (e.g., vibration values) from the vibration sensor 180, in 2000. The controller 190 may also collect data about the number (a) of times of restarting the dehydrating course, in 2100. The controller 190 may also collect data about dehydration time spent to complete the dehydrating course, in 2200. Furthermore, the controller 190 may collect data about the weight of the laundry that is obtained through a weight detecting process in the beginning of the dehydrating course, in 2300.

In the following description, for convenience of explanation, data about a vibration value measured by the vibration sensor 180 during the dehydrating course, data about the number of times of restarting the dehydrating course in multiple laundry cycles, data about time spent to complete the dehydrating course, and data about weight of the laundry contained in the drum 130 are collectively called laundry data.

The laundry data may be stored in the memory 192 or transmitted to the external server 300 through the communication device 195.

In an embodiment of the disclosure, the controller 190 may train an artificial neural network with the laundry data as training data, in 2400.

When the processor 191 includes an artificial intelligence (AI) dedicated processor (e.g., neural processing unit (NPU)) to train the artificial neural network, the processor 191 may train the artificial neural network by using the laundry data stored in the memory 192 as training data of the artificial neural network.

Examples of the learning algorithm may include supervised learning, unsupervised learning, semi-supervised learning, or reinforcement learning, without being limited thereto.

The artificial neural network may include a plurality of neural network layers. Each of the plurality of neural network layers may have a plurality of weight values, and perform neural network operation through operation between an operation result of the previous layer and the plurality of weight values. The plurality of weight values owned by the plurality of neural network layers may be optimized by learning results of the AI model. For example, the plurality of weight values may be updated to reduce or minimize a loss value or a cost value obtained by the AI model during a training procedure. An artificial neural network may include, for example, a convolutional neural network (CNN), a deep neural network (DNN), a recurrent neural network (RNN), a restricted Boltzmann machine (RBM), a deep belief network (DBN), a bidirectional recurrent deep neural network (BRDNN), or a deep Q-network, without being limited thereto.

The processor 191 may learn relations between the laundry data, at least one condition for changing the acceptable standard of vibration (e.g., the preset first value (a1), the preset second value (a2) and/or the preset number (d)), and a plurality of vibration limit values included in the acceptable standard of vibration (e.g., the plurality of first vibration limit values, the plurality of second vibration limit values and/or the plurality of third vibration limit values).

For example, the processor 191 may estimate a change in laundry data expected when at least one condition for changing the acceptable standard of vibration is arbitrarily changed and/or a change in laundry data expected when a plurality of vibration limit values are changed, based on the relations between the laundry data, at least one condition for changing the acceptable standard of vibration, and a plurality of vibration limit values.

The artificial neural network trained by the processor 191 may use the laundry data as input data to output an optimal condition for changing the acceptable standard of vibration and an optimal vibration limit value.

In another example, the external server 300 may train the artificial neural network based on the laundry data received from the washing machine 10. In this case, the washing machine 10 may transmit the laundry data to the external server 300; the external server 300 may use the laundry data received from the washing machine 10 as input data to the trained artificial neural network to determine an optimal condition for changing the acceptable standard of vibration and an optimal vibration limit value; and the washing machine 10 may receive the optimal condition for changing the acceptable standard of vibration and the optimal vibration limit value from the external server 300.

Referring to FIG. 15, the controller 190 may use the laundry data as input data to the trained artificial neural network, in 2500.

The trained artificial neural network may output the optimal condition for changing the acceptable standard of vibration and the optimal vibration limit value as output data.

The controller 190 may change a plurality of preset standards based on the optimal vibration limit value output from the artificial neural network, in 2600.

For example, the controller 190 may use the laundry data as input data to the trained artificial neural network to change at least one of the plurality of first vibration limit values, the plurality of second vibration limit values or the plurality of third vibration limit values.

Furthermore, the controller 190 may change at least one preset condition for changing the acceptable standard of vibration to the optimal condition for changing the acceptable standard of vibration output from the artificial neural network, in 2700.

For example, the controller 190 may use the laundry data as input data to the trained artificial neural network to change at least one of the preset first value (a1) or the preset second value (a2).

In another example, the controller 190 may use the laundry data as input data to the trained artificial neural network to change the preset number (d).

According to the disclosure, the laundry data obtained from the washing machine 10 may be used as training data to train the artificial neural network, and the laundry data may be input to the trained artificial neural network to determine optimal conditions and standards for minimizing vibrations and dehydration time.

Meanwhile, the embodiments of the disclosure may be implemented in the form of a recording medium for storing instructions to be carried out by a computer. The instructions may be stored in the form of program codes, and when executed by a processor, may generate program modules to perform operation in the embodiments of the disclosure. The recording media may correspond to computer-readable recording media.

The computer-readable recording medium includes any type of recording medium having data stored thereon that may be thereafter read by a computer. For example, it may be a ROM, a RAM, a magnetic tape, a magnetic disk, a flash memory, an optical data storage device, etc.

The computer-readable storage medium may be provided in the form of a non-transitory storage medium. The term 'non-transitory storage medium' may mean a tangible device without including a signal, e.g., electromagnetic waves, and may not distinguish between storing data in the storage medium semi-permanently and temporarily. For example, the non-transitory storage medium may include a buffer that temporarily stores data.

In an embodiment of the disclosure, the aforementioned method according to the various embodiments of the disclosure may be provided in a computer program product. The computer program product may be a commercial product that may be traded between a seller and a buyer. The computer program product may be distributed in the form of a recording medium (e.g., a compact disc read only memory (CD-ROM)), through an application store (e.g., Play store™), directly between two user devices (e.g., smart phones), or online (e.g., downloaded or uploaded). In the case of online distribution, at least part of the computer program product (e.g., a downloadable app) may be at least temporarily stored or arbitrarily created in a recording medium that may be readable to a device such as a server of the manufacturer, a server of the application store, or a relay server.

According to the disclosure, vibration noise caused during a dehydrating course may be prevented while the time required for the dehydrating course is minimized.

According to the disclosure, an optimal acceptable standard of vibration may be determined by taking laundry habits of a user into account.

According to the disclosure, needs of various consumers to wash various types of objects for washing may be satisfied.

According to the disclosure, an optimal acceptable standard of vibration may be determined by machine learning.

According to the disclosure, a more reliable acceptable standard of vibration may be selected by using robust variables.

The embodiments of the disclosure have thus far been described with reference to accompanying drawings. It will be obvious to those of ordinary skill in the art that the disclosure may be practiced in other forms than the embodiments as described above without changing the technical idea or essential features of the disclosure. The above embodiments of the disclosure are only by way of example, and should not be construed in a limited sense.

What is claimed is:

1. A washing machine comprising:

a tub;

a drum in the tub;

a motor configured to rotate the drum;

a vibration sensor configured to detect vibration of the tub as the drum is rotated during a dehydrating course, and to produce a corresponding vibration value; and a controller configured to:

stop the motor to stop the dehydrating course based on the vibration value produced by the vibration sensor indicating that vibration of the tub exceeds an acceptable standard of vibration during the dehydrating course, and thereafter restart the dehydrating course, and change the acceptable standard of vibration based on a number of times of restarting the dehydrating course in a plurality of laundry cycles, wherein the acceptable standard of vibration includes a first acceptable standard of vibration, a second acceptable standard of vibration, and a third acceptable standard of vibration, the controller is configured to:

restart the dehydrating course in response to the vibration value exceeding the first acceptable standard of vibration based on a first preset time not having passed from a point in time at which the dehydrating course is started a first time, restart the dehydrating course in response to the vibration value exceeding the second acceptable standard of vibration based on the first preset time having passed and a second preset time not having passed from the point in time at which the dehydrating course is started the first time, and restart the dehydrating course in response to the vibration value exceeding the third acceptable standard of vibration based on the second preset time having passed from the point in time at which the dehydrating course is started the first time, and the controller is configured to change the acceptable standard of vibration by changing at least one of the first acceptable standard of vibration, the second acceptable standard of vibration, and the third acceptable standard of vibration.

2. The washing machine of claim 1, wherein the controller is configured to:

decrease an average of a plurality of vibration limit values included in the acceptable standard of vibration based on the number of times of restarting the dehydrating course being smaller than a preset first value, maintain the acceptable standard of vibration based on the number of times of restarting the dehydrating course being equal to or greater than the preset first value, and smaller than a preset second value, and increase the average of the plurality of vibration limit values included in the acceptable standard of vibration based on the number of times of restarting the dehydrating course being equal to or greater than the preset second value.

3. The washing machine of claim 1, wherein, the first acceptable standard of vibration, the second acceptable standard of vibration and the third acceptable standard of vibration are each set to a first standard, a second standard, or a third standard, the first standard includes a plurality of first vibration limit values corresponding to a plurality of sections of the dehydrating course, the second standard includes a plurality of second vibration limit values corresponding to the plurality of sections of the dehydrating course, the third standard includes a plurality of third vibration limit values corresponding to the plurality of sections of the dehydrating course, and an average of the plurality of first vibration limit values is smaller than an average of the plurality of second vibration limit values, and the average of the plurality of second vibration limit values is smaller than an average of the plurality of third vibration limit values.

4. The washing machine of claim 1, further comprising:

a display, wherein the controller is configured to control the display to output at least one of a visual indication indicating the number of times of restarting the dehydrating course and a message corresponding to the number of times of restarting the dehydrating course.

5. The washing machine of claim 1, further comprising:

a communication device, wherein the controller is configured to control the communication device to transmit information about the number of times of restarting the dehydrating course to an external device.

6. The washing machine of claim 2, wherein, the controller is configured to change at least one of the preset first value and the preset second value according to data input to a pre-trained artificial neural network, including data about the vibration value produced by the vibration sensor during the dehydrating course, data about the number of times of restarting the dehydrating course in the plurality of laundry cycles, data about time spent to complete the dehydrating course, and data about a weight of laundry contained in the drum.

7. The washing machine of claim 3, wherein, the controller is configured to change at least one of the plurality of first vibration limit values, the plurality of second vibration limit values, and the plurality of third vibration limit values according to data input to a pre-trained artificial neural network, including data about the vibration value produced by the vibration sensor during the dehydrating course, data about the number of times of restarting the dehydrating course in the plurality of laundry cycles, data about time spent to complete the dehydrating course, and data about a weight of laundry contained in the drum.

8. The washing machine of claim 1, further comprising:

a control panel configured to receive a user input to change the acceptable standard of vibration, wherein the controller is configured to change the acceptable standard of vibration based on the user input.

9. A method of controlling a washing machine, the method comprising:

detecting vibration of a tub of the washing machine as a drum in the tub is rotated during a dehydrating course, and producing a corresponding vibration value;

stopping a motor that rotates the drum, to stop the dehydrating course, based on the vibration value indicating that the vibration of the tub exceeds an acceptable standard of vibration during the dehydrating course;

restarting the dehydrating course; and changing the acceptable standard of vibration based on a number of times of restarting the dehydrating course in a plurality of laundry cycles, wherein the acceptable standard of vibration includes a first acceptable standard of vibration, a second acceptable standard of vibration, and a third acceptable standard of vibration, and the restarting of the dehydrating course comprises:

restarting the dehydrating course in response to the vibration value exceeding the first acceptable standard of vibration based on a first preset time not having passed from a point in time at which the dehydrating course is started a first time, restarting the dehydrating course in response to the vibration value exceeding the second acceptable standard of vibration based on the first preset time having passed and a second preset time not having passed from the point in time at which the dehydrating course is started the first time, and restarting the dehydrating course in response to the vibration value exceeding the third acceptable standard of vibration based on the second preset time having passed from the point in time at which the dehydrating course is started the first time, and the changing the acceptable standard of vibration comprises changing at least one of the first acceptable standard of vibration, the second acceptable standard of vibration, and the third acceptable standard of vibration.

10. The method of claim 9, wherein the changing of the acceptable standard of vibration comprises:

decreasing an average of a plurality of vibration limit values included in the acceptable standard of vibration based on the number of times of restarting the dehydrating course being smaller than a preset first value;

maintaining the acceptable standard of vibration based on the number of times of restarting the dehydrating course being equal to or greater than the preset first value and smaller than a preset second value; and increasing the average of the plurality of vibration limit values included in the acceptable vibration level based on the number of times of restarting the dehydrating course being equal to or greater than the preset second value.

11. The method of claim 9, wherein:

the first acceptable standard of vibration, the second acceptable standard of vibration and the third acceptable standard of vibration are each set to a first standard, a second standard, or a third standard, the first standard includes a plurality of first vibration limit values corresponding to a plurality of sections of the dehydrating course, the second standard includes a plurality of second vibration limit values corresponding to the plurality of sections of the dehydrating course, the third standard includes a plurality of third vibration limit values corresponding to the plurality of sections of the dehydrating course, and an average of the plurality of first vibration limit values is smaller than an average of the plurality of second vibration limit values, and the average of the plurality of second vibration limit values is smaller than an average of the plurality of third vibration limit values.

* * * * *